US005458726A

United States Patent [19]

Castoldi

[11] Patent Number: 5,458,726

[45] Date of Patent: Oct. 17, 1995

[54] APPARATUS FOR APPLYING ADHESIVE HANDLES TO LOADS

[75] Inventor: Roberto Castoldi, Milan, Italy

[73] Assignee: Minnesota Mining and Manufacturing Company, St. Paul, Minn.

[21] Appl. No.: 158,907

[22] Filed: Nov. 29, 1993

[30] Foreign Application Priority Data

Nov. 30, 1992 [IT] Italy ..... MI92A002738

[51] Int. Cl.[6] ..... B32B 31/00; B26D 5/00

[52] U.S. Cl. ..... 156/355; 156/354; 156/363; 156/475; 156/486; 156/522; 53/134.1; 53/413

[58] Field of Search ..... 53/134.1, 413; 156/468, 475, 481, 486, 351, 353, 354, 355, 360, 361, 362, 363, 522

[56] References Cited

U.S. PATENT DOCUMENTS

| | | | |
|---|---|---|---|
| 3,557,516 | 1/1971 | Brandt | 53/134 |
| 4,415,399 | 11/1983 | Geisinger | 156/486 X |
| 4,477,304 | 10/1984 | Westermann | 156/522 X |
| 4,640,731 | 2/1987 | Lerner et al. | 156/355 |
| 4,683,017 | 7/1987 | Figiel et al. | 156/468 X |
| 4,700,528 | 10/1987 | Bernard | 53/398 |
| 4,758,301 | 7/1987 | Inoko et al. | 156/361 |
| 4,830,895 | 5/1989 | Bernard | 428/34.2 |
| 4,889,581 | 12/1989 | Ulrich et al. | 156/522 X |
| 4,906,319 | 3/1990 | Fiorani | 156/355 X |
| 4,936,945 | 6/1990 | Marchetti | 156/468 |
| 5,052,165 | 10/1991 | Gunther | 53/413 |
| 5,079,900 | 1/1992 | Pinckney et al. | 53/413 |

FOREIGN PATENT DOCUMENTS

| | | | |
|---|---|---|---|
| 0560699A1 | 9/1993 | European Pat. Off. | G65B 61/14 |
| 2678238 | 12/1992 | France | 53/413 |
| 2688471A1 | 9/1993 | France | B65B 61/14 |
| 1142303 | 10/1986 | Italy . | |
| 1279036 | 8/1970 | United Kingdom | B65B 61/14 |
| 1383108 | 6/1972 | United Kingdom | B65B 61/14 |

OTHER PUBLICATIONS

International Search Report mailed Apr. 26, 1994 (International Application No. PCT/US93/11504).

*Primary Examiner*—David A. Simmons
*Assistant Examiner*—Paul M. Rivard
*Attorney, Agent, or Firm*—Gary L. Griswold; Walter N. Kirn; James J. Trussell

[57] ABSTRACT

The present invention provides an apparatus for applying an adhesive handle to a load, both if it is a pack of items kept together by a unitizing means such as heat-shrunk wrapping or if it is a single article such as a box. More specifically, the apparatus for applies adhesive handles to loads that as they are driven along a path, the apparatus in its preferred embodiment being characterized by a rotatable lever having two opposing arms, either of the arms being in turn positioned within the path. A holding means is provided on the lever for carrying a handle to lay on a surface of the two arms of the lever with its non-adhesive side against the surface of the lever and its adhesive side exposed. Additionally a lever driving means is provided to controllably rotate the lever by about 180° after a load that is driven along the path hits an arm of the lever that is positioned within the path.

With such an apparatus, the front side of each load that is driven along the path hits against a first arm of the lever, i.e., the arm positioned within the path. On that arm, one of the adhesive portions of the handle is exposed, so that such adhesive portion can be adhered to the load. Immediately thereafter, because of the impact of the load, the lever driving means is activated so as to rotate the lever by about 180° at a rotational speed so that the other arm of the lever hits the back side of the load. At that moment, the other adhesive portion of the handle, laying exposed on such other arm of the lever, is adhered to the load. Thus, the two adhesive portions of the handle are adhered to spaced portions of the load, while the non-adhesive side extends therebetween, over the load.

23 Claims, 10 Drawing Sheets

17
18
25
25
48
48'
49
49'
50
50'
12
29
47
47'
46
46'
Y
Y
44
45
43
42
36
36A
36B
36C
36D
36E
36'
36'A
36'B
36'C
36'D

APPARATUS FOR APPLYING ADHESIVE HANDLES TO LOADS

FIELD OF THE INVENTION

The present invention relates to an apparatus for applying adhesive handles to loads driven along a path, for example in a packaging system.

BACKGROUND

Many goods intended for domestic use (such as drinks, paper rolls, washing powders and liquids, soaps) are often packed in multipacks, including a rather large number of single items, kept together by a box or by a heat shrinkable wrapping. Such packs are normally named loads, and such name will be used throughout the following description and claims.

Preferably, loads are provided with an upper carrying handle, to allow them to be easily carried by a single hand.

Very much appreciated for their simplicity and their low cost are adhesive handles. A handle of this kind normally consists of a length of adhesive tape, the middle portion of which is made non-adhesive, for example by applying a paper strip. Therefore, the handle includes, one after the other, an adhesive portion, a non-adhesive portion and a further adhesive portion.

Handles of this type are described, for example, in U.S. Pat. No. 4,906,319, together with a method and apparatus for their manufacture and application to loads having a heat shrinkable wrapping. According to this reference, handles are constructed from non-heat-shrinkable tape and paper tape portions which are cut from one another and applied to the hot shrinkable film before it is wrapped around the goods. After wrapping a load, the wrapping is heat shrunk about the load which is thereby provided with an adhesive handle.

A similar method is described in U.S. Pat. Nos. 4,700,528, and 4,830,895 wherein adhesive tape handles are applied to a shrinkable wrapping before heating. In this case the handle consists of a length of adhesive tape (without any non-adhesive portion) which is adhered to the wrapping. A set of perforation lines are provided through the wrapping alongside the central portion of the handle. After shrinking, openings are formed along the central portion of the handle to allow the insertion of a hand to grasp the load. The non-adhesive portion consists of the central portion of adhesive tape adhered to the wrapping between the set of perforation lines.

U.S. Pat. No. 3,557,516 describes a similar method comprising the steps of adhering an unshrinkable ribbon material to a shrinkable film material at spaced intervals, wrapping the film around a load, and shrinking the film against the load to cause the unshrinkable ribbon to bulge outwardly to define a carrying handle.

All the previous methods describe the application of handles to a wrapping material before wrapping the load and shrinking the wrapping material.

U.S. Pat. No. 4,758,301 describes an apparatus for applying handles to loads comprising an intermittently driven rotating drum having on its outer peripheral surface a suction means for holding a handle tape supplied from a reel. The drum moves the handle tape through a cutter to cut predetermined lengths of the tape to form handles and then, to a position wherein handles are adhesively applied to a load by applicator arms.

Apparatuses to apply adhesive tape directly to loads are also generally known in the art. Typically, they comprise a plurality of pivotally mounted arms which guide the tape to be adhered on the load and they require a separate cutting means to cut a predetermined length of tape. These apparatuses could be used for applying tape handles, if the predetermined length corresponds to that of a handle, but, they are complex and expensive, and require expensive maintenance due to their high number of moving parts.

An example of this type of machine is disclosed in Italian patent No. 1,142,303. Described is an apparatus for applying a length of adhesive tape around a load, comprising a first applying arm to adhere a leading end of adhesive tape to the front side of the coming load and two other springs-arms to press the tape on the upper and back side of the load. A further arm is provided to cut the length of tape.

BRIEF DESCRIPTION OF THE INVENTION

The present invention provides an apparatus for applying an adhesive handle to a load, both if it is a pack of items kept together by a unitizing means such as heat-shrunk wrapping or if it is a single article such as a box.

The disadvantages and shortcoming associated with the prior art are overcome by the present invention by providing a preferred apparatus for applying adhesive handles to loads that are driven along a path, characterized by comprising a rotatable lever having two opposing arms, either of the arms being in turn positioned within the path. A holding means is provided on the lever for carrying a handle to lay on a surface of the two arms of the lever with its non-adhesive side against the surface of the lever and its adhesive side exposed. Additionally a lever driving means is provided to controllably rotate the lever by about 180° after a load that is driven along the path hits an arm of the lever that is positioned within the path.

With such an apparatus, the front side of each load that is driven along the path hits against a first arm of the lever, i.e., the arm positioned within the path. On that arm, one of the adhesive portions of the handle is exposed, so that such adhesive portion can be adhered to the load. Immediately thereafter, because of the impact of the load, the lever driving means is activated so as to rotate the lever by about 180° at a rotational speed so that the other arm of the lever hits the back side of the load. At that moment, the other adhesive portion of the handle, laying exposed on such other arm of the lever, is adhered to the load. Thus, the two adhesive portions of the handle are adhered to spaced portions of the load, while the non-adhesive side extends therebetween, over the load.

The object of the present invention may also be attained by an apparatus as described above, but comprising a lever having only one arm provided that the lever driving means controls and drives this single arm to rotate by about 360° after a load that is driven along the path hits the arm positioned in its rest position within the path.

Accordingly, another embodiment of the present invention comprises an apparatus for applying adhesive handles to loads driven along a path, characterized by comprising a lever having one arm, positioned in a rest position across the path. A holding means is provided on the arm for carrying a handle to lay on a surface of the arm with its non-adhesive side against the surface of the arm and its adhesive side exposed. Additionally, a lever driving means is provided to controllably rotate the arm by about 360° after a load that is driven along the path hits the arm positioned within the path.

With such an apparatus, the front side of each load that is driven along the path hits against the front face of the arm positioned within the path. On the arm, one of the adhesive portions of the handle is exposed, so that such adhesive portion is adhered to the load. Immediately thereafter, because of the impact of the load, the arm driving means are activated so as to rotate the arm by about 360° at a rotational speed so that the back face of the arm hits the back side of the load. At that moment, the other adhesive portion of the handle, laying exposed on the back face of the arm, is adhered to the load. Thus, the two adhesive portions of the handle are adhered to spaced portions of the load, while the non-adhesive side extends therebetween, over the load.

The handles are preferably supplied to the apparatus of the present invention in the form of a handle tape, i.e., a tape in which the handles follow one after the other. Practically speaking, such a handle tape is an adhesive tape, having non-adhesive portions at regular spaced intervals. The tape which can be made, for example, by means of an apparatus such as the one described in the U.S. Pat. No. 4,906,319 noted above in the Background section of the present application. Moreover, the tape may be provided in a ready-to-use form or prepared by a specific apparatus connected to the apparatus of the present invention.

In order for the apparatus of the present invention to be able to operate with a handle tape, the lever comprises a cutting means to cut each consecutive handle from the handle tape. Preferably, the cutting operation is performed after the handle has been adhered to the load.

In order to improve the sliding of the handle tape over the surface of the lever, the lever preferably comprises a bar having two opposite smooth sliding faces linked therebetween by two rounded ends of the bar. On such a lever, the holding means preferably comprise holes formed on the sliding faces of the lever which are permanently connected with a vacuum source.

The cutting means preferably comprises two blades, one for each arm, transversely provided at the apex of the rounded ends of the lever. Each blade is preferably independently driven along the lever by its own pneumatic means between a rest position in which the blade does not project from the rounded end of the lever and a cut position in which the blade projects from the rounded end.

Preferably, the rounded ends of the lever are formed on bodies that are movably disposed within the lever to move between a rest position in which they allow easy sliding of the handle tape and an extended position in which they cooperate to improve adhering of the handle cut from the handle tape to the back side of the load. In fact, since the tape is cut in the middle of the rounded ends, its trailing end portion would tend not to be positively adhered to the load because it is not pressed thereon by the lever. However, the projecting movement of the rounded ends advantageously completes the adhering operation by pressing the trailing end portion against the load.

Movement of the rounded end bodies may be obtained in various manners. According to a preferred manner, the pneumatic means of the blades also operate the rounded end bodies of the lever by way of a lost motion arrangement, which first pushes the blade out from the rounded end and then projects the body of the rounded end itself. This solution is very advantageous in that multiple tasks are performed from a single driving means.

The handle may be simply adhered onto the load, without concern for the provision of a space under the middle non-adhesive portion thereof. In fact, in most cases the irregular shape and/or the deformability of the load will make it possible to insert a hand under the handle. However, it may further be preferred to have a definite loop formed in the middle portion of the handle to ensure that a free space is left under the handle. To do this, the apparatus may also comprise a loop forming arrangement. According to a preferred embodiment, such a loop forming arrangement includes two retractable pins mounted on the lever projecting from respective positions that are laterally offset from the middle of the lever. Each pin is preferably driven by its own pneumatic means between a retracted position and a projecting position.

Activation of the various driven parts may be obtained in many different ways. Preferably, the lever driving means comprises an electric motor and an electric brake-clutch, activated by a position sensor which is located close to the lever and senses when the lever is moved by the impact of the load. Preferably, the pneumatic means of the blades are activated by an optical sensor which is oriented toward the fed handle tape and senses when a complete handle has been fed. In addition, the apparatus may preferably comprise position sensing means to recognize which one of the arms of the lever is across the path of the loads and therefore which blade is to be activated.

Further features and advantages of an apparatus according to the invention will become clear from the following description of plural embodiments thereof.

DETAILED DESCRIPTION OF THE INVENTION

Figure 1:
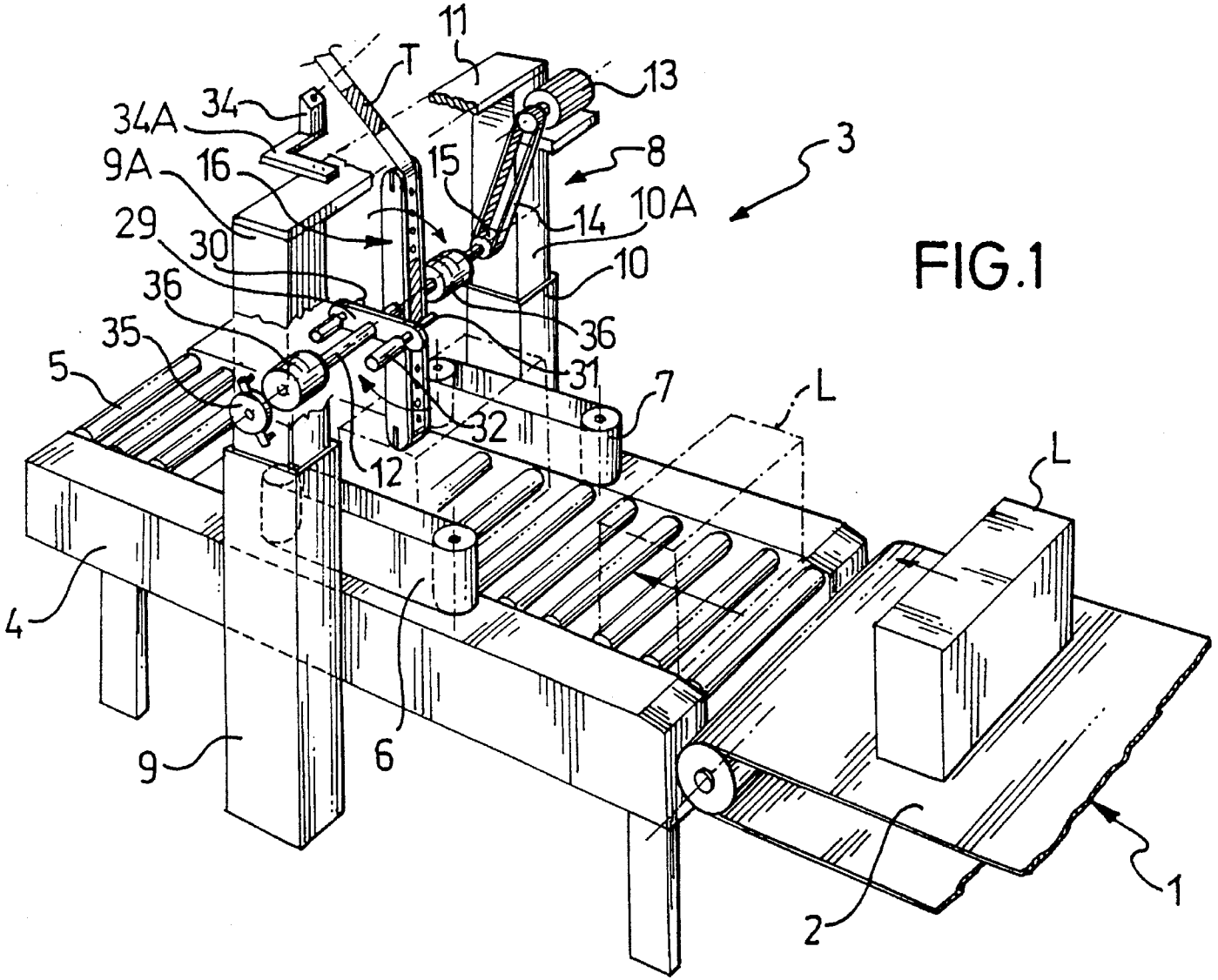
FIG. 1 is a schematic perspective view of an apparatus according to the invention, provided as part of a load path.

Referring now to the drawings wherein like numerals are used to designate like components throughout the several figures, L indicates a generic load, which may be constituted by a simple box or by any of other regularly or irregularly shaped packages of goods. As shown in FIG. 1, the loads L are driven along a load path 1, comprising, for example, a belt conveyor 2. A station 3 is provided as a part of the load path 1 for the application of a handle H to each load L driven on the load path 1.

The station 3 includes a load bearing structure 4, having a number of idle rollers 5 which are part of the load path 1. In the middle portion of the load bearing structure 4, two powered side belts 6 and 7 are provided to guide and drive the loads L in a precise orientation along the load path 1. Such powered side belts 6 and 7 are conventionally known and are preferably adjustably mounted to the load bearing structure 4 to permit adjustment of the width of the load path 1. Moreover, the belts are conventionally driven to move the loads L through the station 3 at normal operating speeds. All other suitable conveying means are also contemplated. Also provided in the same middle portion of the load bearing structure 4 is an apparatus 8 for applying the adhesive handles H (see FIG. 5) to the loads L.

Handles H are fed to the apparatus 8 in form of a handle tape T. Such a tape is, practically speaking, a sequence of handles not yet divided from one another. In the drawings, in order to avoid confusion, the reference H has been used only when a handle is separated from the tape; handles still to be separated have the reference T, as being still part of the handle tape. The handle tape T (and each handle H as well) has a first side which is completely non-adhesive while the other side has adhesive and non-adhesive portions. For the sake of convenience this other side will be referred to throughout this application simply as "adhesive" although it also includes non-adhesive portions.

The apparatus 8 comprises two uprights 9 and 10 at both sides of the structure 4, connected by a transverse reinforcing beam 11 standing over the structure 4. Uprights 9 and 10 preferably comprise telescoping units including an adjustment mechanism such as a lead screw arrangement (not shown) which can be manually or power driven to permit vertical adjustment of upper portions 9A and 10A thereof, as are well known. A horizontal rotating shaft 12 is preferably rotatably supported by the adjustable upper portions 9A and 10A of the uprights 9 and 10 and is driven by an electric motor 13, via a transmission device such as belt 14 and an electric brake-clutch 15. The rotating shaft 12 is conventionally supported by bearing arrangements (not shown) within the upright upper portions 9A and 10A. Such beating arrangements permit rotation of the shaft 12 relative to the uprights 9 and 10 but substantially prevent axial movement of the rotating shaft 12. Moreover, all of the rotatable connections, sensors and other equipment described below and that are provided on the rotating shaft 12 are preferably provided above the structure 4 between the uprights 9 and 10. The electric clutch-brake 15 is conventionally known and comprises an electromagnetic brake. When the clutch is deactivated, the brake is activated and the rotating shaft 12 is prevented from rotating. Meanwhile, the outer clutch portion of the clutch-brake 15 continues to rotate as it is continuously driven by the belt 14. However, since the clutch is deactivated, transmission to the rotating shaft 12 does not occur. When the clutch is activated, the brake is deactivated and the rotating shaft 12 is rotationally connected to rotate with the outer clutch portion as it is driven from the motor 13 by the belt 14. Control for the timing of the activation and deactivation of the clutch and brake are described below. Such a conventional electric clutch-brake 15 is manufactured by Gerit S.p.A. of Milan, Italy. The motor 13 is run continuously and is preferably supported on the upper portion 10A of upright 10 to move vertically with the rotating shaft 12.

Figure 2:
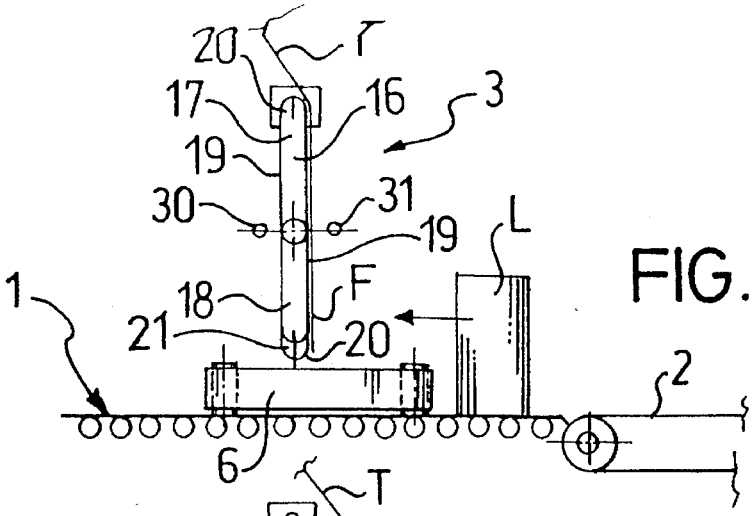
FIGS. 2 to 5 are schematic side views of the apparatus of FIG. 1, showing various subsequent operating phases.

A lever 16 is keyed on the shaft 12 to rotate therewith. The lever 16 is made up of two opposing identical arms 17 and 18 which are rotationally in turn positioned across the path 1. As shown in FIG. 2, the lever 16 comprises a bar having two opposite smooth sliding faces 19 linked one to the other by two rounded ends 20 of the bar.

Figure 6:
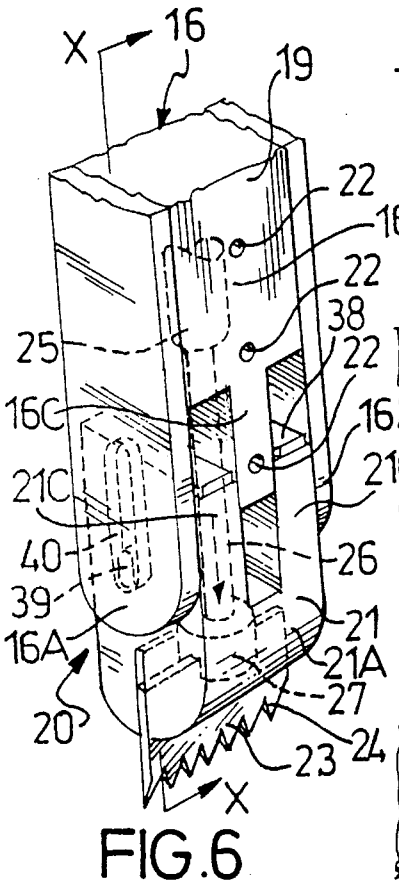
FIG. 6 is an enlarged perspective view of a rounded end of the lever of the apparatus of FIG. 1.

As shown in FIGS. 6–9, a major portion of the rounded ends 20 of the lever 16 are formed on bodies 21, which are movably disposed from within the lever 16 to extend in an axial direction thereof. The remainder of the rounded ends 20 are made up by the ends of side plates 16A which together fixed with a middle bar 16B make up the lever 16. The inside surface of at least one of and preferably both of the side plates 16A adjacent to the moving bodies 21 are provided with a pair of longitudinal slots or grooves 40 arranged parallel to the longitudinal axis of the lever 16. The longitudinal slots 40 receive a pair of pins 39 that extend from the lateral walls of the bodies 21, thereby guiding and limiting the stroke of the bodies 21. Moreover, a central extension portion 16C of this middle bar 16B extends longitudinally, as shown in FIG. 6, so as to inter face with leg portions 21C of the bodies 21 to assist in guiding bodies 21. A retainer element 38 is conventionally fixed at the top of said bodies 21, and more particularly to the tops of each of the leg portions 21C of the bodies 21. The retainer element 38 has the double function of holding together two semi-portions 21A and 21B that preferably make up the bodies 21 and of providing a seat 38A for returning the bodies 21 to their retracted position, as will be more fully explained below.

Figure 12:
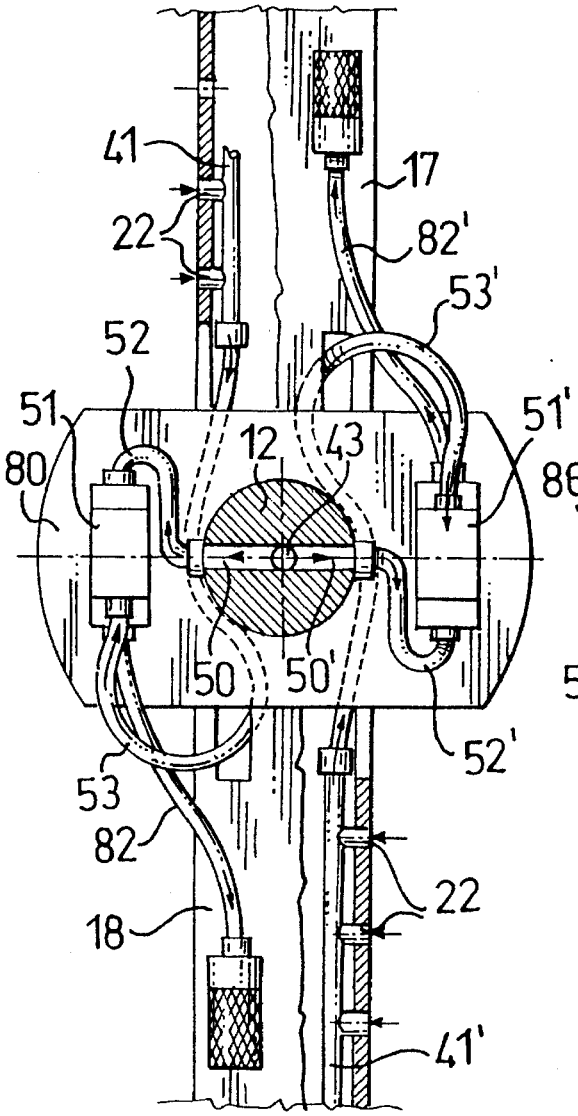
FIG. 12 is a lateral view partially in cross-section of the lever showing the vacuum connections of the lever holding means and the vacuum producing means.

The lever 16 also includes holding means for carrying a handle so as to lie against the faces 19 of the arms 17, 18 with its non-adhesive side against the lever 16 and its adhesive side exposed. Such means includes a number of orifices 22, opening through both of the sliding faces 19. As illustrated in FIG. 12, the orifices 22 are connected to ducts 41 and 41' that end at the ends of the arms 17 and 18 proximate to the rotating shaft 12. The end portions of the ducts 41 and 41' are each permanently connected to a vacuum source, which will be described hereinafter.

Also on the lever 16, cutting means is provided to cut handles H from the handle tape T. Such cutting means includes two identical blades 23, one for each of the arms 17 and 18. Blades 23 are provided at the extreme positions of the rounded ends 20 of the lever 16 and are transversely oriented with respect to the handle tape T. Moreover, the blades 23 are slidingly engaged within a slot defined in the bodies 21. The slot is preferably defined between the two semi-portions 21A and 21B of the bodies 21. Preferably, the blades 23 have a serrated edge to make cutting easier.

Bodies 21 and blades 23 have common pneumatic driving means for extending them from the arms 17 and 18, acting through a lost motion arrangement. Within a cavity provided inside each of the arms 17 and 18 of the lever 16, a pneumatic cylinder 25 is mounted for extending and retracting a stem 26 that is further provided with a hammer head 27. The pneumatic cylinders 25 are of a conventionally known type having a single piston movable between two positions, such as that manufactured by Festo Pneumatic (Germany). Hammer head 27 is fixed with the blade 23 so as to move therewith in the axial direction of the lever 16. Furthermore, the hammer head 27 is slidingly engaged in a longitudinal cavity 28 formed in the body 21. The longitudinal cavity 28 has an axial extension greater than the axial dimension of the hammer head 27 and has a seat 28A against which the hammer head 27 abuts so that the hammer head 27 has a first part of its extension stroke in which it moves only the blade 23 and a second part of its extension stroke in which it moves the blade 23 and the body 21. The first part of the extension stroke corresponds to the degree of the projection of the blade 23 from the rounded end 20 of the body 21. The second part of the extension stroke corresponds to the degree of projection of the body 21 from the lever 16. The spacer element 38, that connects the two semi-portions 21A and 21B together, is further provided with an opening 37 that substantially corresponds to but is slightly larger than the diameter of the stem 26 and which is smaller than the radial dimension of the hammer head 27. This difference defines the radial extent of the seat 38A. When the pneumatic cylinder 25 is retracted from its fully extended position, the hammer head 27 has a first part of its retraction stroke defined by the difference between the axial extension of the longitudinal cavity 28 and the hammer head 27 in which it retracts only the blade 23 and a second part of its retraction stroke, after having hit the seat 38A of the spacer element 38, in which it retracts the blade 23 and the body 21.

The apparatus 8 also preferably comprises a loop forming arrangement to ensure that a certain space is left open for inserting a hand under each applied handle. It is understood that such loop forming arrangement is not necessary and the use thereof depends lately on the type of load to which the tape handle H is to be applied. This arrangement comprises, as shown in FIG. 1, a support 29 fixed to rotate with the lever 16, either by direct joining with the lever 16 or, as in the shown example, by being keyed onto the same shaft 12. On the support 29, two extendible and retractable pins 30 and 31 are provided, in respective positions laterally offset from the middle of the lever 16. Each of the pins 30 and 31 is driven by its own pneumatic cylinder 32 between a retracted position, in which the pin does not interfere with the application of the handle tape T, and a projecting position, in which the pin interferes with the application of the handle tape T. In the interfering position, the pin projects at least partially across the width of the sliding surface 19 over which the tape T rides. The pneumatic cylinders 32 are single piston two-position cylinders of a conventionally known type, such as manufactured by Festo Pneumatic (Germany).

The apparatus 8 also comprises various sensing means to detect various situations and to activate the apparatus accordingly. Generally speaking, such sensing means can be optical, magnetic or inductive. Optical sensing means comprise a light source and a photocell, which detects when an object interrupts the light beam. Magnetic or inductive sensing means comprise a cam keyed on the rotating shaft providing a variation of the magnetic or electric field of one or two sensors mounted laterally to the cam.

Figure 3:
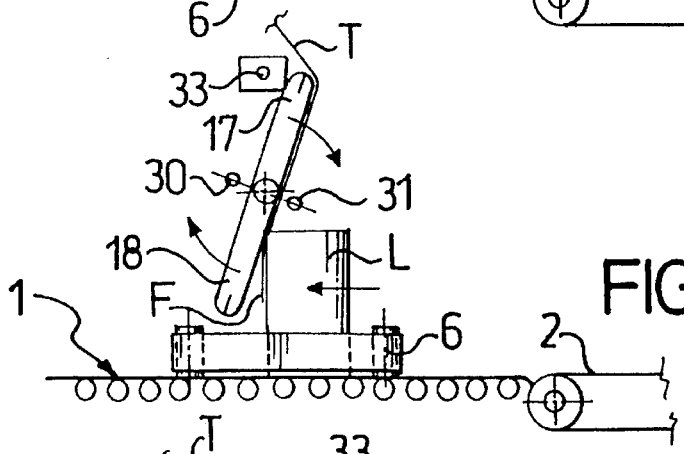
Figure 4:
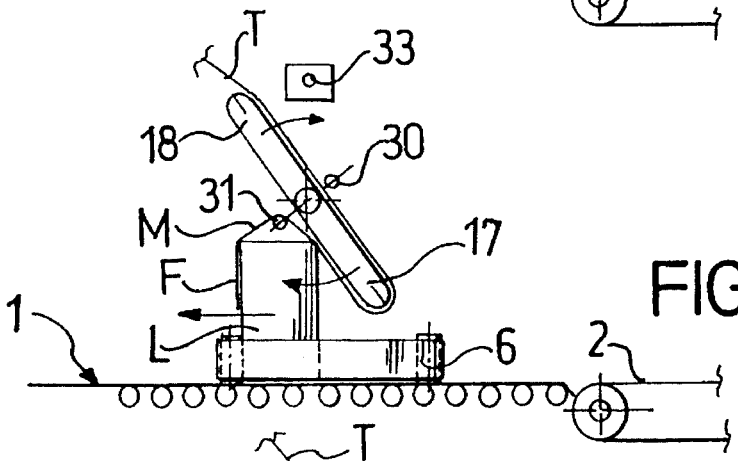
Figure 5:
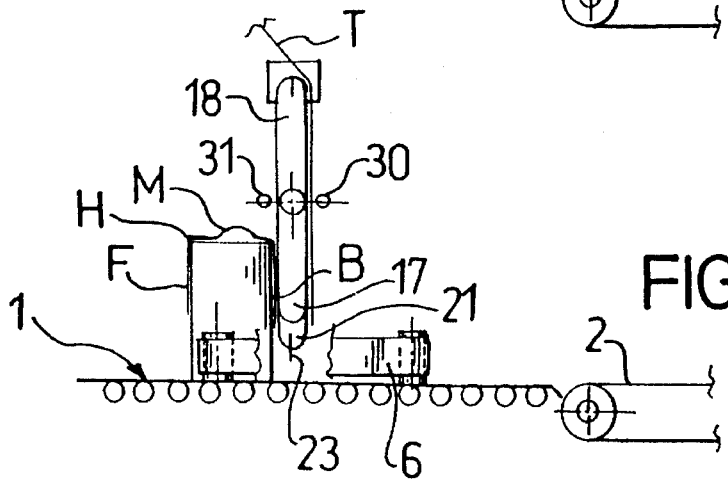

In particular, as shown in FIGS. 3–5, an optical sensor 33 is preferably provided to detect when the lever 16 is moved by the impact of an incoming load L. The sensor 33 can be conveniently mounted to uprights 9 and 10 or to the beam 11. Another optical sensor 34 (see FIG. 1) is mounted on the beam 11 by a bracket 34A and is oriented toward the fed handle tape T to detect when a complete handle has been fed. Preferably, the optical sensor 34 reacts to some feature or condition of the tape T and is preset to indicate the passage of a complete handle H in the form of the tape T.

An angular position sensing means 35 is also provided on the shaft 12 as also schematically illustrated in FIG. 1. According to a preferred embodiment of the present invention the rotating shaft 12 is provided with two of such position sensing means 35 and 35' illustrated in FIGS. 25 and 24, respectively. The first and second sensing means 35 and 35' can be mounted anywhere along shaft 12 so long as they don't interfere with the other equipment. Preferably, they are mounted near the uprights 9 or 10 or by other supporting structure so that the sensors can be fixed in position relative to the rotating shaft 12.

Figure 25:
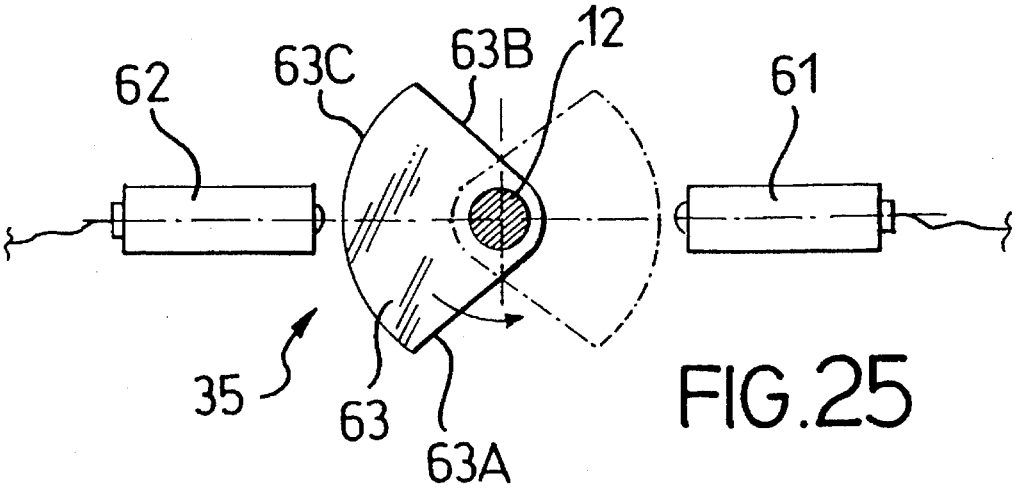
FIG. 25 is an enlarged view of the position sensing means for controlling the projection of the blades.

Referring to FIG. 25, a first sensing means 35 comprises two inductive sensors 61 and 62 mounted laterally adjacent to a first cam 63 rotatable with shaft 12. The position of the first cam 63 controls the projection and the retraction of the pneumatic cylinder 25 of the proper arm 17 or 18. More specifically, one of the inductive sensors 61 and 62 controls cylinder 25 of arm 17 while the other inductive sensor controls cylinder 25 of arm 18. Each of the fixed sensors 61 and 62 reads the position of the specific cam 63 rotating with shaft 12. The rotation of the cam 63 causes a variation of the electric field of the sensors 61 and 62 in an alternating manner thereby activating the projection and retraction of the pneumatic cylinder 25 of the arm 17 or 18 at the proper times. The cam 63 includes a leading edge 63A, a trailing edge 63B and an arcuate edge 63C between the leading edge 63A and the trailing edge 63B. As a matter of example, when the leading edge 63A is rotated in front of the sensor 61, a variation of the electric field is sensed by inductive sensor 61. At this point, a cylinder 25 of one of arms 17 and 18 is activated, i.e., extended. During the time that the arcuate edge 63C is before the inductive sensor 61, the activated cylinder 25 remains extended. Then, when the trailing edge 63B passes the inductive sensor 61, the sensor 61 senses the change in electric field back to the normal, and the cylinder 25 is controlled to retract. The same sequence of events then happens to the other cylinder 25 of the other of arms 17 and 18 as the cam 63 is rotated past the inductive sensor 62. The effect of the sequential extending and retracting of the cylinders 25 of the arms 17 and 18 will be more fully understood in the description of the operation below.

Figure 24:
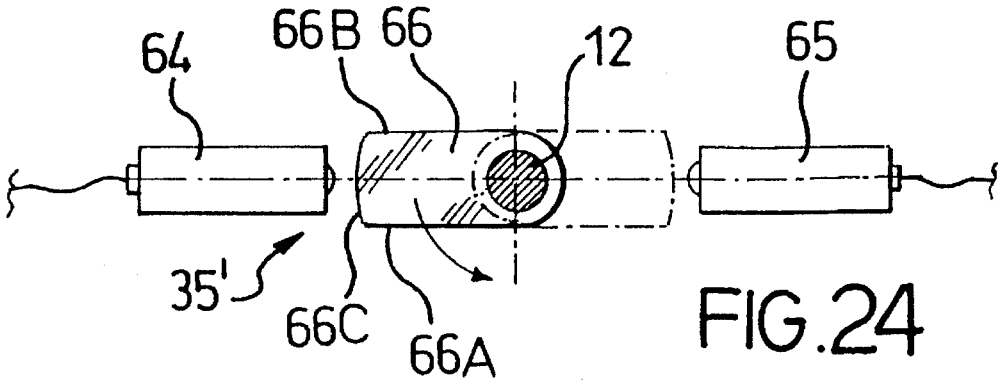
FIG. 24 is an enlarged view of the position sensing means for controlling the projection of the pins of the loop forming arrangement.

Similarly, a second sensing means 35', as shown in FIG. 24, comprises two inductive sensors 64 and 65 mounted laterally adjacent to a second cam 66 also rotatable with shaft 12. The position of the second cam 66 controls the projection and the retraction of the pneumatic cylinder 32 of the proper pin 30 or 31. More particularly, the second sensing means 35' comprises two inductive sensors 64 and 65 reading the position of a second cam 66 keyed to the rotating shaft 12. The position of the second cam 66 controls the projection and retraction of the pneumatic cylinders 32 of the pins 30 and 31 in proper sequence and in a similar manner as that described above for the first sensing means 35. One of the inductive sensors 64 and 65 controls the extension and retraction of the cylinder 32 of one of the pins 30 and 31, and the other inductive sensor 64 or 65 controls the extension and retraction of the cylinder 32 of the other of the pins 30 and 31. Specifically, when the leading edge 66A is rotated before sensor 65, the extension of one cylinder 32 is activated. That cylinder stays extended during the time that the arcuate edge 66C is in front of the sensor 65 until the trailing edge 66B passes by the sensor 65. Immediately thereafter, the extended cylinder 32 is controlled to retract. This same sequence of events is then controlled to happen to the other cylinder 32 of the other pin 30 or 31. Continued rotation of shaft 12 thereby causes the extension and retraction of the cylinders 32 in an alternating manner. The effect of this operation will be more fully appreciated from the description of the operation of the invention below. These inductive sensing means 35 and 35' themselves are conventionally known and manufactured by various companies, such as, the example, Saiet S.p.A. (Italy), Omron K.K. (Japan), Telemecanique (France) and Festo Pneumatic AG (Germany).

The various pneumatic elements of the apparatus are fed via respective ducts provided within the rotating shaft 12 and in the lever 16. Such ducts end in rotating connections, which are in turn connected to a suitable pressure source.

Figures 10, 11:
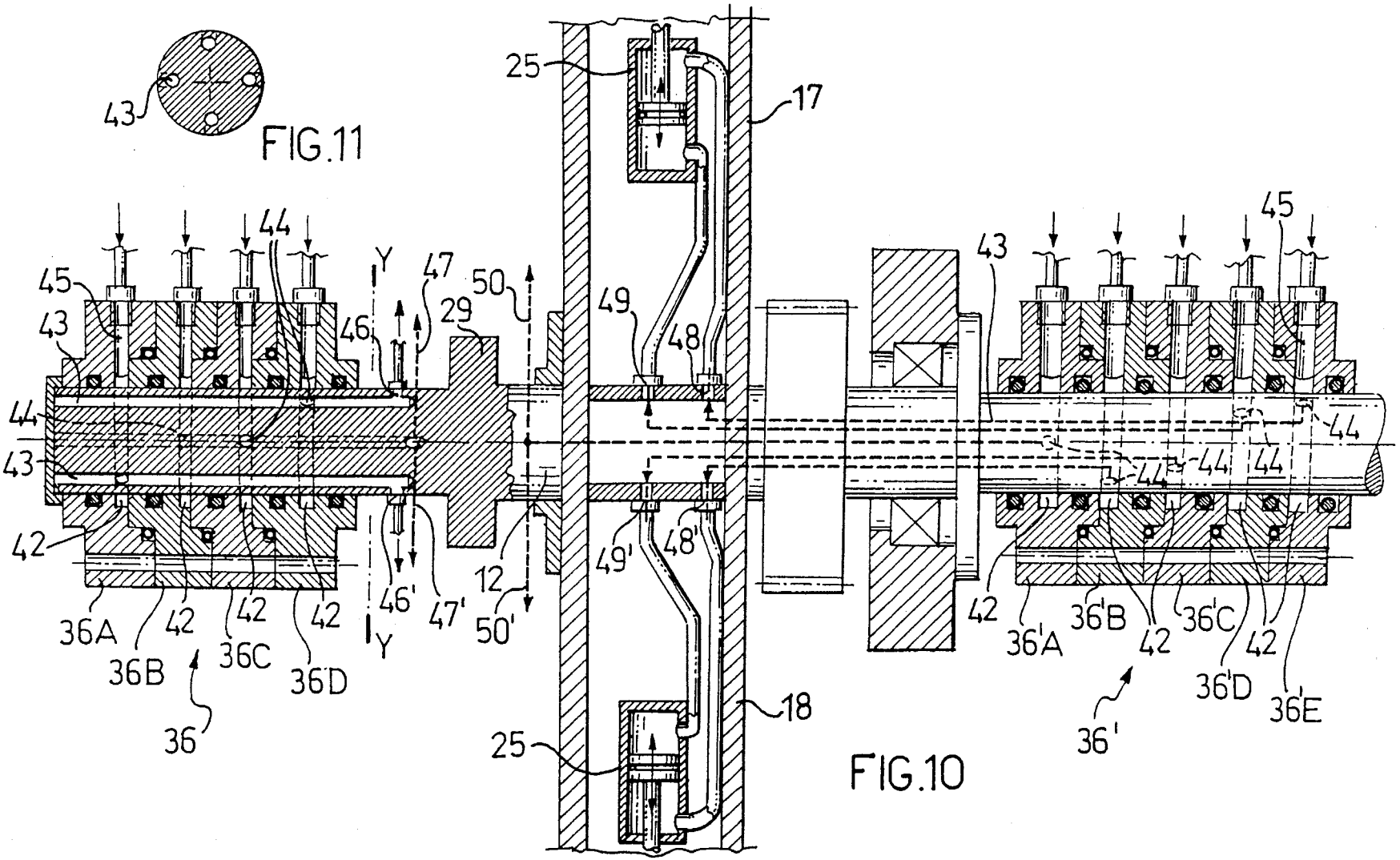
FIG. 10 is a schematic view partially in cross-section of the rotating connections and of the rotating shaft showing the pneumatic connections between the rotating shaft and the lever.
FIG. 11 is a cross-sectional view of the rotating shaft taken along line Y—Y in FIG. 10.

A cross-sectional view of suitable rotating connections which are connected to a pneumatic source (not shown) for controlling the pneumatic cylinders 25 and 32 is illustrated in FIG. 10. Such rotating connections themselves are generally conventionally known. According to one embodiment, a first rotating connection comprises a pneumatic sleeve 36 made up of four annular portions 36A, B, C and D which are, sealingly connected together to act as a unitary sleeve, within which the shaft 12 is rotatable. Moreover, the four annular portions 36A, B, C and D define four annular internal chambers 42 that are open to the rotating shaft 12. The corresponding section of the rotating shaft 12 is provided with four internal ducts 43 that are connected through passages 44 to the corresponding annular chambers 42. Each duct 43 is continually in fluidic communication with one of the annular chambers 42 during rotation of the shaft 12. FIG. 11 shows the disposition of the four ducts 43 within the rotating shaft 12. Each annular chamber 42 is connected to the external through a duct 45, which is further connected to a conventional pressurized air source (not shown). The sleeve 36 can be non-rotationally mounted about the shaft 12 by any conventional support connected with the apparatus frame. Preferably, the connection of the ducts 45 to lines that are connected to the pressurized air source maintains the sleeve 36 non-rotational.

The internal ducts 43 end within shaft 12 proximate to the location on the shaft 12 of the cylinders 32 which, as described above, are connected to rotate with shaft 12 by support 29. Radial passages 46, 46', 47 and 47' connect the ends of the internal ducts 43 to external of the shaft 12. Each of the passages 46 and 46' is conventionally connected through a plastic tube, to the lower portion of one of the pneumatic cylinders 32 of the respective pins 30 and 31. Cylinders 32 are of the well-known two chamber type, wherein the two chambers are separated by a sliding piston such that one chamber is selectively expandable while the other is collapsed. The sliding piston is connected with a rod that extends from the cylinder for connection to pin 30 or 31 for controlling projection and retraction thereof. Air pressure supplied through the passages 46 and 46' causes the pins 30 and 31 to be retracted and air pressure supplied through the passages 47 and 47' causes the pins 30 and 31 to be projected.

FIG. 10 also illustrates a cross-section of the rotating connection connected to the pneumatic source (not shown) for controlling the pneumatic cylinders 25 of the lever 16 and to provide a vacuum source to the holes 22. This second rotating connection comprises another pneumatic sleeve 36' made up of five annular portions 36'A, B, C, D and E which are sealingly connected together to act as a unitary sleeve within which the shaft 12 is rotatable. Moreover, the five annular portions 36'A, B, C, D and E define five annular internal chambers 42 opening to the rotating shaft 12. Each annular chamber 42 is connected to the external through a duct 45, which is further connected to the pressurized air source (not shown). Again, the sleeve 36' can be non-rotationally mounted by any conventional support connected with the appropriate frame, and such is preferably simply provided by the lines that connect the ducts 45 to the pressurized air source.

Five corresponding internal ducts 43 are provided within the corresponding section of the shaft 12 which are connected through passages 44 to the corresponding annular chambers 42, one duct 43 is connected to each of the annular chambers 42. Thus, each duct 43 is continually in fluidic communication with one of the annular chambers 42 during rotation of the shaft 12. Four out of the five ducts 42 end within shaft 12 proximate to the location of the lever 16 thereon. Radial passages 48, 48', 49 and 49' connect the ends of the internal ducts 43 to external of shaft 12 but within the lever 16. The passages 48 and 48' are conventionally connected, through a plastic tube, to the lower portions of the pneumatic cylinders 25 of the respective arms 17 and 18. The passages 49 and 49' are conventionally connected to the upper portion of the pneumatic cylinders 25 of the respective arms 17 and 18. The pneumatic cylinders 25, as shown in FIG. 10, are also of the well-known two chamber type similar to cylinders 32, discussed above. The sliding piston of each cylinder 25 is connected with a rod that extends from the cylinder for connection to the stem 26 of the hammer head 27 for controlling the projection and retraction thereof. Air pressure supplied through the passages 48 and 48' causes the blade 23 and body portion 21 of arms 17 and 18 to be retracted and air pressure supplied through the passages 49 and 49' causes the blade and body portion 21 of arms 17 and 18 to be projected.

Figure 13:
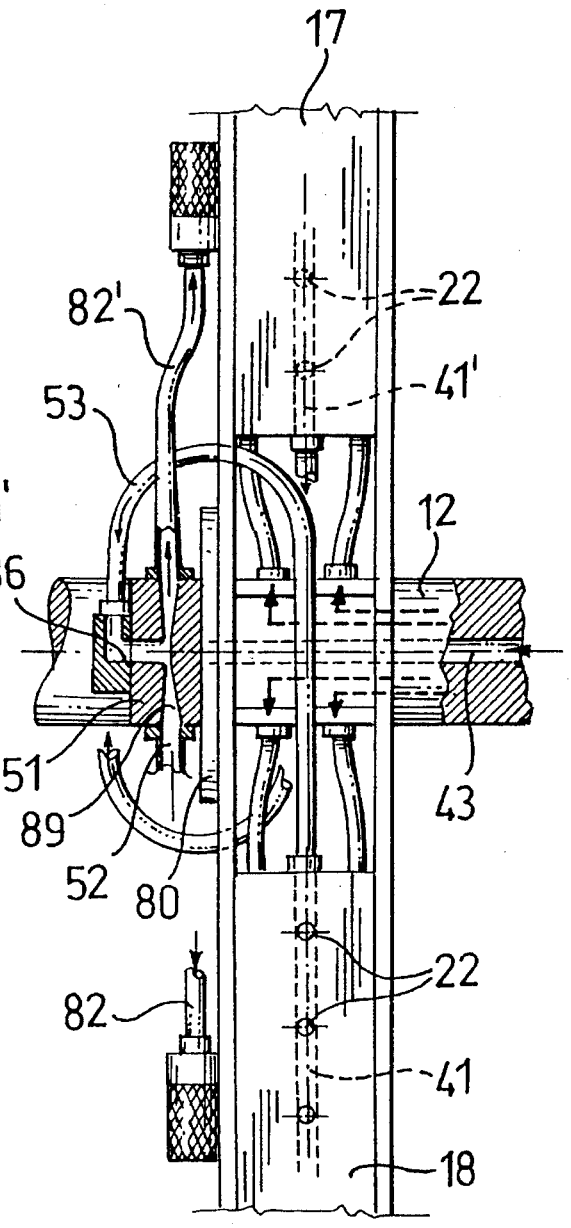
FIG. 13 is a front view of the lever showing a partial cross-section of a vacuum producing means.

The fifth duct 43 ends within shaft 12 proximate to the location of a vacuum producing means 51 and 51'. Radial passages 50 and 50' connect the fifth duct 43 to external of the shaft 12. As shown in FIGS. 12 and 13, the vacuum producing means 51 and 51' are preferably mounted to a support plate 80 which is connected to rotate with shaft 12. Moreover, the vacuum producing means 51 and 51' are conventionally connected to lines 52 and 52', respectively which are in turn connected to the passages 50 and 50', respectively, that both connect with the fifth duct 43. Exhaust lines 82 and 82' also run from the vacuum producing means 51 and 51', respectively. Vacuum lines 53 and 53' also run from the vacuum producing means 51 and 51', respectively, and are connected with the ducts 41 and 41', respectively, as described above (and then to the holes 22) of arms 17 and 18.

Vacuum producing means 51 and 51' are known per se for producing a vacuum in one line of each of means 51 and 51' (lines 53 and 53') as a result of air pressure supplied in another line (lines 52 and 52') and exhausted through a third line (lines 82 and 82'). More specifically, each vacuum producing means 51 and 51', as shown in FIG. 13, includes a first passage 84 which is gradually throttled down at one point. From that throttled point, another passage 86 extends substantially normal to the passage 84, and the passage 86 is connected with line 53 or 53'. Pressurized air supplied through lines 52 and 52' passes through passages 84 of each vacuum producing means 51 and 51', including the throttled point thereof, and exits through line 82 and 82'. Vacuum is thus created in passages 86 and lines 53 and 53' as a result.

Figure 26:
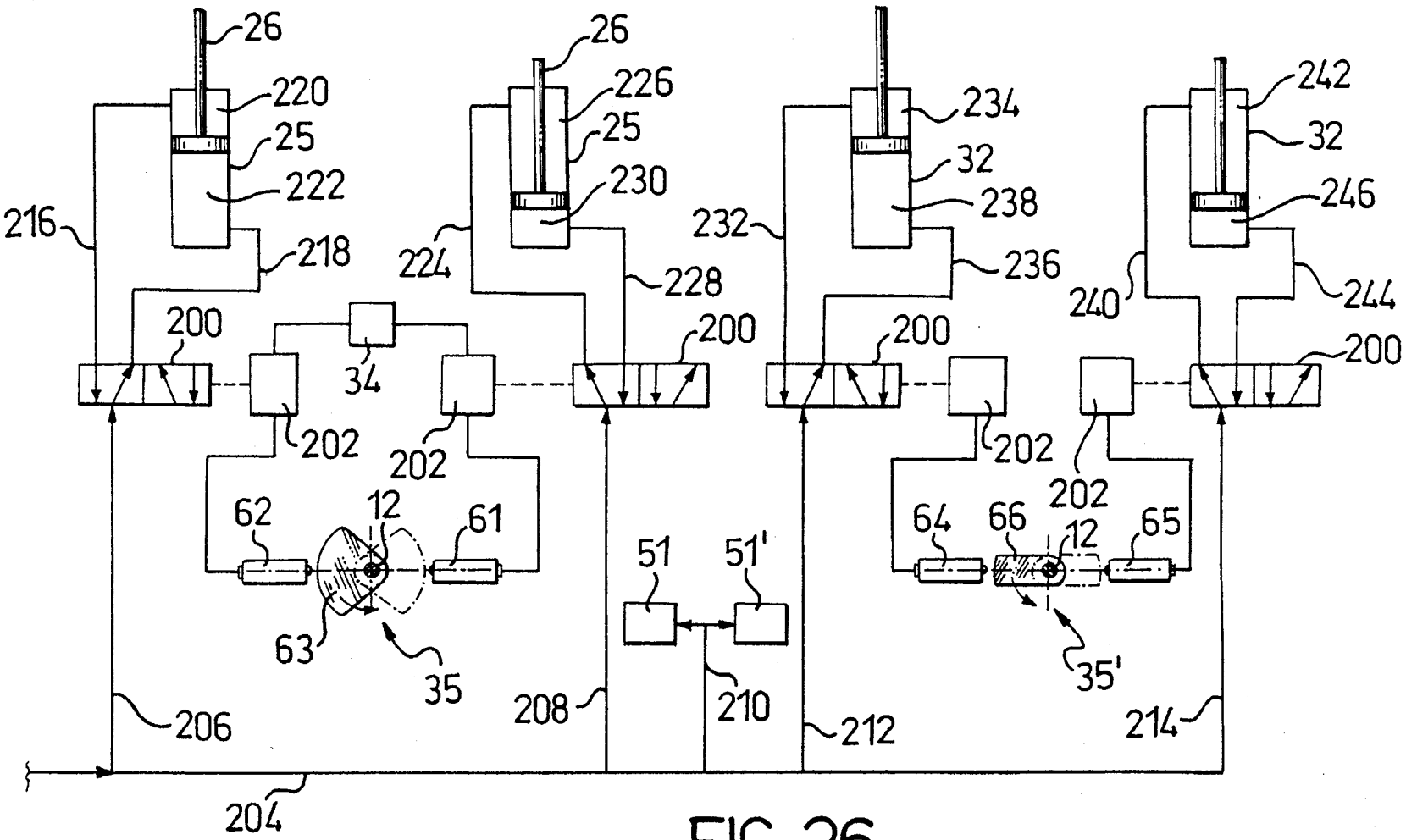
FIG. 26 is a schematic view of the pneumatic circuit and sensor system for controlling the operation of the apparatus of the present invention.

In order to control the cylinders 25 and 32, and more particularly to control the extension and retraction of the bodies 21 and the pins 30 and 31, respectively, a pneumatic circuit is provided which is schematically illustrated in FIG. 26. The pneumatic circuit includes a number of two-position valves 200, one for each cylinder 25 and 32, and acts in conjunction with the sensors 34, 35 and 35', discussed above, and a like number of electromagnetic solenoids 202 to together comprise a control means of the present invention. Suitable two-position valves 200 that are provided combined with solenoids 202 as a unit are conventionally known and commercially available, such as for example from Festo Pneumatic AG (Germany). One valve 200 and solenoid 202 set is provided for each of the sensors 61 and 62 of position sensor 35 and for each of the sensors 64 and 65 of position sensor 35'. The sensor 34 is also electrically connected with the valve 200 and solenoid 202 sets associated with the sensors 61 and 62, as will be more specifically described below.

Pressurized air is supplied from a source, not shown, to a pressurized rail 204 from which pressure lines 206, 208, 210, 212 and 214 extend.

Line 206 is connected with a valve 200 from which a pair of lines 216 and 218 extend which are in turn connected with a cylinder 25 of one of the arms 17 and 18. Line 216 connects to an upper chamber 220 of the cylinder 25 and line 218 connects to a lower chamber 222 of the cylinder 25. The associated valve 200 operates such that one of lines 216 and 218, and thus one of the upper and lower chambers 220 and 222, is connected to the pressurized air source, while the other is connected to exhaust. This extends or retracts the cylinder 25. As shown in FIG. 26, the cylinder 25 is extended by pressurized air from line 206 supplied through line 218 to the lower chamber 222, while the upper chamber 220 is exhausted. To retract the cylinder 25, the valve 200 is shifted to the left by the solenoid 202 under the control of sensors 62 and 34, which appropriately connects line 216 and the upper chamber 220 to pressurized air while the lower chamber 222 is exhausted.

Line 208 is likewise connected to a valve 200 from which a line 224 is connected to an upper chamber 226 of the second cylinder 25 and a line 228 is connected to a lower chamber 230 of the second cylinder 25. As illustrated, the valve 200 is operatively positioned so that pressurized air is supplied from line 208 through valve 200 and line 224 to the upper chamber 226 so as to retract the second cylinder 25. To extend the cylinder 25, the valve 200 is shifted to the left by the solenoid 202 under the control of the sensors 61 and 34. As a result, pressurized air is supplied to the lower chamber 230 from the line 208 through valve 200 and line 228 while the upper chamber 226 is exhausted.

Line 212 is connected to a valve 200 from which a line 232 is connected to an upper chamber 234 of the cylinder 32 of one of the pins 30 and 31 and a line 228 is connected to a lower chamber 230 of that cylinder 32. As illustrated, the valve 200 is operatively positioned so that pressurized air is supplied from line 212 through valve 200 and line 236 to the lower chamber 238 so as to extend that cylinder 32. To retract that cylinder 32, the valve 200 is shifted to the left by the solenoid 202 under the control of the sensor 64. As a result, pressurized air is supplied to the upper chamber 234 from the line 212 through valve 200 and line 232 while the lower chamber 238 is exhausted.

Line 214 is connected to a valve 200 from which a line 240 is connected to an upper chamber 242 of the cylinder 32 of the other one of pins 30 and 31 and a line 244 is connected to a lower chamber 246 of that other cylinder 32. As illustrated, the valve 200 is operatively positioned so that pressurized air is supplied from line 214 through valve 200 and line 240 to the upper chamber 242 so as to retract that cylinder 32. To extend that cylinder 32, the valve 200 is shifted to the left by the solenoid 202 under the control of the sensor 65. As a result, pressurized air is supplied to the lower chamber 246 from the line 214 through valve 200 and line 244 while the upper chamber 242 is exhausted.

As described above, the cutting operation, and more specifically the timed extension and retraction of cylinders 25, is governed by the activation and deactivation of the respective solenoids 202 and the resultant shifting of their valves 200 as controlled by a combination of sensors, namely the sensor 34 which senses the dispensing of a complete length of a tape handle in tape form and one of the sensors 61 and 62 of the position sensor 35. Specifically, as soon as the leading edge 63A of the earn 63 is in front of sensor 61 or 62 and for as long as any portion of the arcuate edge 63C remains in front, the sensor 61 or 62 sends a signal to the respective solenoid 202 to shift its valve 200 and extend the respective cylinder 25. However, the respective cylinder 25 is not extended until the respective solenoid also receives a signal from the sensor 34, which occurs at precisely the dispensing of a single length of a tape handle. Thus, the cutting operation is readied by the signal from the sensor 61 or 62 and the operation is triggered by the sensor 34. The respective cylinder 25, however, remains extended for as long as the signal from sensor 61 or 62 is sent to its solenoid 202; that is all the while that the arcuate edge 63C is in front of the sensor 61 or 62. The solenoid 202 is deactivated when the trailing edge 63C passes the sensor 61 or 62, and respective cylinder 25 is retracted. The logic for activating and deactivating the cylinders 25 is maintained by the solenoids 202.

The operation of pins 30 and 31, and more specifically the timed extension and retraction of cylinders 32, is governed by the activation and deactivation of the respective solenoids 202 and the resultant shifting of the respective valves 200 as controlled by the sensors 64 and 65. Specifically, as soon as the leading edge 66A is in front of sensor 64 or 65, and for as long as the arcuate edge 66C is in front of the same sensor 64 or 65, a signal is sent to the respective solenoid 202. For as long as the signal is received by the respective solenoid 202 for the cylinder 32 of pin 30 or 31, that solenoid 202 is activated, its valve 200 is shifted and the cylinder 32 is extended. The solenoid 202 is deactivated when the trailing edge 66B passes the sensor 64 or 65, and the respective cylinder 32 is retracted.

The first and second rotatable connections described above comprising the sleeves 36 and 36' are provided within the lines 210, 216, 218, 224, 228, 232, 236, 240 and 244. Line 210 provides the pressurized air to the vacuum producing means 51 and 51' through sleeve 36'. Lines 232, 236, 240 and 244 connect with the sleeve 36, and lines 216, 218, 224 and 228 connect with sleeve 36'.

With reference now to FIGS. 2–5, the operation of apparatus 8 is described as follows.

Loads L arrive at the station 3 which is located along load path 1 by any conventional means, such as belt conveyor 2. The loads L are driven through station 3 along the load path 1 by side belts 6 and 7 which drive and guide the loads L through station 3. The lever 16 of apparatus 8 is oriented and held in position by the brake of the clutch-brake 15 so as to engage a front surface of the load L with one of its arms 17 or 18. In accordance with the illustrated embodiment, the lever 16 is substantially vertically oriented. In FIG. 2, arm 18 is positioned across the load path 1. The handle tape T is supplied from a source roll and is carried by the lever 16 with its non-adhesive side against a face 19 of lever 16. The tape T is urged against the sliding face 19 of lever 16 by the holding means including holes 22 connected with the vacuum producing means 51 or 51'. The adhesive side of tape T is exposed to face the incoming load L. Body 21 of arm 18 is also in its extended position as controlled by cylinder 25 and its associated sensor device 61–63. Specifically, the cam 63 is positioned such that the one of sensors 61 and 62 which is associated with cylinder 25 of the arm 18 senses the presence of cam 63. Pin 31, which is on the side of the lever 16 toward the incoming load L, is projected, while pin 30 is in its retracted position. Pins 30 and 31 are positioned as controlled by cylinders 32 and the sensor system 64–66. Specifically, the cam 66 is positioned such that the one of sensors 64 and 65 which is associated with cylinder 32 of the pin 31 would sense the presence of cam 66. The leading portion F of tape T which is borne by the arm 18 and which is in position to be impacted by the incoming load L, is an adhesive portion of a handle H.

When the load L hits arm 18 of lever 16, the leading portion F of tape T is adhered to the front side of the load L. At the same time, the lever 16 is rotated from its preset initial position. This movement is detected by the sensor 33 which deactivates the brake of the electric brake-clutch 15 and activates the clutch thereof to establish connection of shaft 12 with motor 13 (which is always running). The activation of the clutch 15 imparts rotation to the lever 16. Moreover, as a result of this initial impact and subsequent rotation of lever 16, the trailing edge 63B of cam 63 moves past the one of the sensors 61 and 62 associated with cylinder 25 of arm 18. Thus, the body 21 of arm 18 is immediately retracted.

With the clutch 15 activated, the shaft 12 is rotated. During such rotation, the handle tape T is maintained at a distance from the top side of the load L by the projected pin 31. Thus, a loop M is formed. The loop portion M corresponds to a non-adhesive portion of the adhesive side of the tape T.

Rotational speed of shaft 12 is set such that the arm 18 runs faster than the load L along load path 1. Thus, the arm 17 hits the backside of load L before it moves to its substantially vertical position. An adhesive portion of the tape T rides on the arm 17 at this moment, and that portion is adhered to the backside of the load L as a result of the impact with lever 17. The pin 31 is retracted before the impact of arm 17 against load L so that tape T is freely applied. Again, this is controlled by the position of cam 66, and more specifically the trailing edge 66C thereof, with respect to the one of sensors 64 and 65 associated with pin 31. Once the arm 17 reaches its substantially vertical position, after a 180° rotation of lever 16, the sensor 33 activates the brake of the brake-clutch 15 and stops the rotation of lever 16. This phase is generally shown in FIG. 5. Also, the cutting operation occurs, the details of which are set forth below.

Cut procedure is activated by the optical sensor 34 after it senses that a full handle length has been dispensed. Moreover, the cutting procedure is activated in combination with the position sensing means 35 which activates and controls the body 21 and blade 23 of arm 17. In other words, the sensor 61 or 62 of the cylinder 25 of arm 17 must sense the cam 63 and the optical sensor 34 must sense passage of an entire handle length for the cutting to occur. The optical sensor 34 controls the exact instant of activation of the cylinder 25 of arm 17. This cutting preferably occurs right when the arm 17 of lever 16 hits the backside of the load L. The length of the handle H having been chosen according to the dimensions of the load L. The optical sensor 34 is a conventionally known photocell which reads the passage of, for example, the non-transparent non-adhesive portion of the handle tape T. Alternatively, it might be decided to activate the cut procedure upon completion of the 180° rotation of lever 16 under only the control of the position sensing means 35. However, this is not preferred because there may be slight variations which might cause problems in the occurrence of any irregularity of operation.

In fact, it should be kept in mind that the handle tape is a prefixed sequence of handles, each of which has the same exact length, while the loads L may be sometimes of irregular shapes. If the cut is not specifically set on the handle sequence, small dimensional errors in the loads can add up from each working cycle and may eventually bring up a complete failure. Such failure could occur when a non-adhesive portion of the adhesive side of the tape T would be attempted to be adhered to the front or back side of a load L.

Moreover, it might happen that an error could occur during one application cycle. In such a case, one or more loads might not be provided with a handle, or might be provided with a misapplied handle. However, if the cutting operation is set with the length of each handle, the operation will return to normal automatically without the need for stopping the station and readjusting the apparatus.

Once the cutting operation is activated, the pneumatic cylinder 25 is extended. In the first part of its stroke, only the blade 23 is projected from the arm 17 of lever 16. The body 21 remains within the arm 17. A tape handle H is thus immediately cut from the tape T by the blade 23, see FIG. 8. During the second part of the stroke of cylinder 25, the body 21 and blade 23 are together projected from arm 17. As a result, the trailing edge B of the applied handle H is completely adhered to the backside of the load L, see FIG. 9. In other words, the extension of the body 21 more completely adheres the trailing edge B against the load L. Again, this operation is controlled by the movement of cam 63 in front of the one of sensors 61 and 62 associated with cylinder 25 of arm 17.

Figure 9:
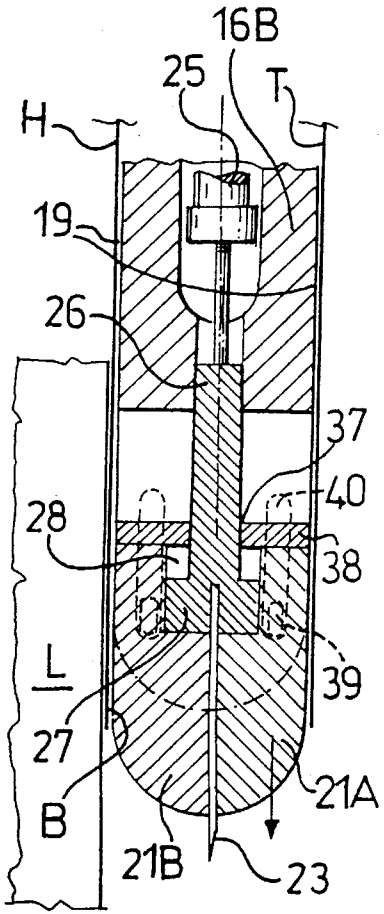
FIGS. 7 to 9 are cross-sectional views of the rounded end taken along line X—X in FIG. 6, showing various subsequent operating phases.
Figure 8:
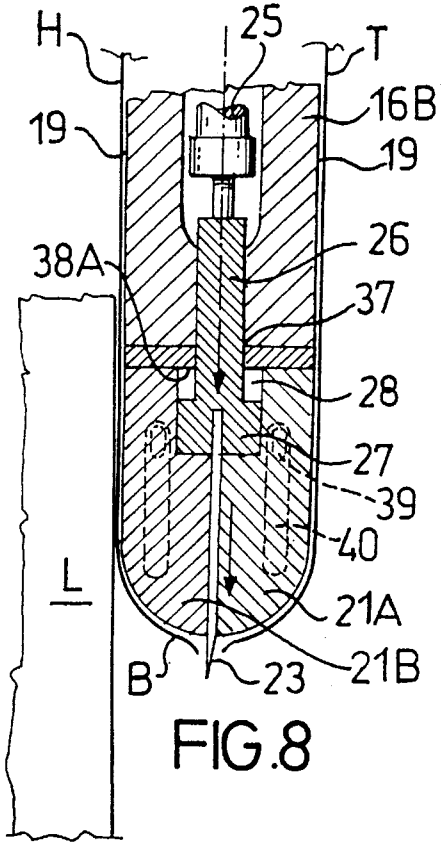
Figure 7:
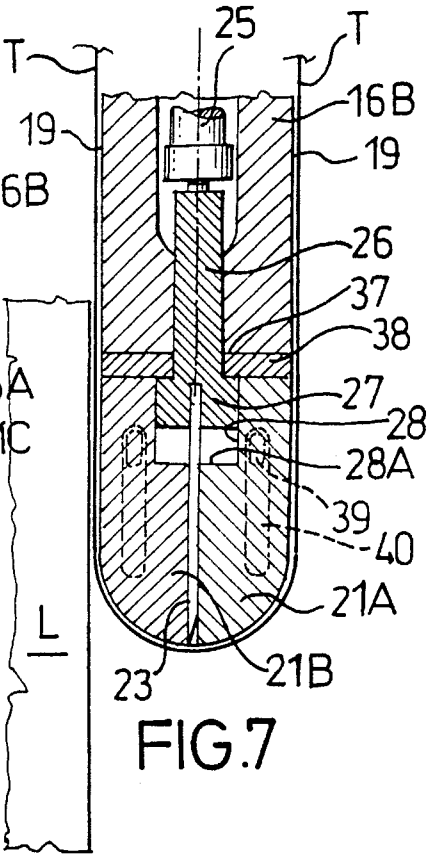

At the end of one working cycle, the blade 23 and body 21 remain in their projected position, as shown in FIG. 9 and FIG. 2. Thus, arm 17 of lever 16 is now positioned across the load path 1 and is ready to be impacted by a next incoming load L. As above, the body 21 and blade 23 are retracted immediately after the load hits the arm 17 and the trailing edge 63B of cam 63 is moved by the sensor 61 or 62 of the cylinder 25 of arm 17. The operation of the next application is just like that described above, except that the arm 17 is initially impacted by the next load L, and the arm 18 finishes the application of the next handle H. Thus, the arms 17 and 18 are alternatingly impacted by the loads L.

Another embodiment of the apparatus of the present invention is operationally described with reference to FIGS. 14–18. As previously mentioned, the apparatus of the present invention can work with a lever comprising only one arm. However, the driving means must make the single lever rotate by about 360° for each application of a handle H as a result of a load hitting the arm positioned in its rest position within the path of load L.

Figure 14:
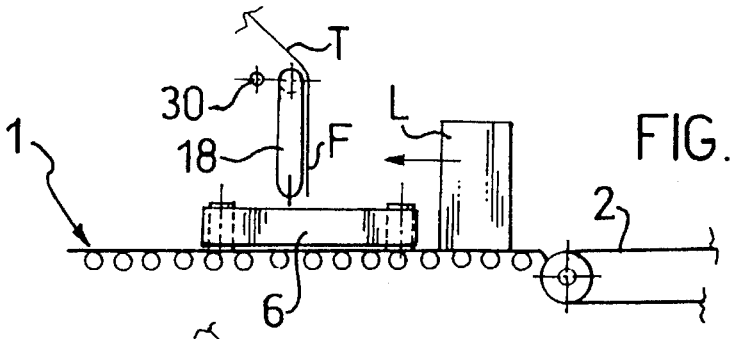
FIGS. 14 to 18 are schematic side views of another embodiment of an apparatus in accordance with the present invention, showing various subsequent operating phases.

More specifically, a load L is driven along the load path 1 to the station 3, by belts 6 and 7 so as to impact the arm 18 which is at rest positioned across the load path 1. In this initial state, the body 21 associated with the arm 18 and its blade 23 are projected. Moreover, the pin 30 is in its retracted position. It is noted that only a single pin 30 is required since a complete rotation of arm 18 is required for each handle application. The first portion of tape T, that is the portion F lying against arm 18, is an adhesive portion. This phase is illustrated in FIG. 14.

Figure 15:
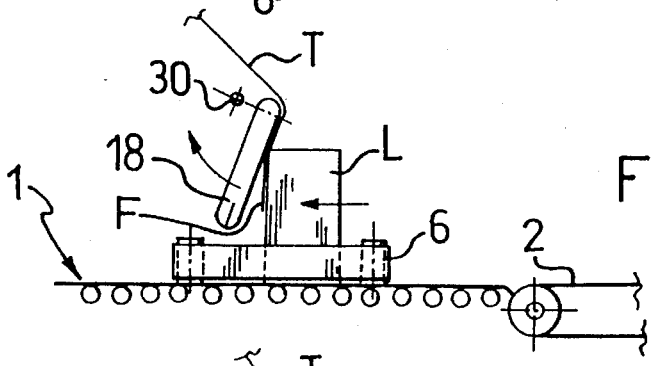

When the load L impacts arm 18, the portion F of the tape T is adhered to the front side of the load L. At the same time, the arm 18 is moved from its original rest position, and this movement is detected by a first position sensing means (not shown) which is similar to sensor 33, described above. This movement deactivates the brake and activates the clutch 15 to establish a running connection between the motor 13 and shaft 12. This impact initiates the rotation of 360° of the arm 18. This phase of operation is shown in FIG. 15.

Figure 16:
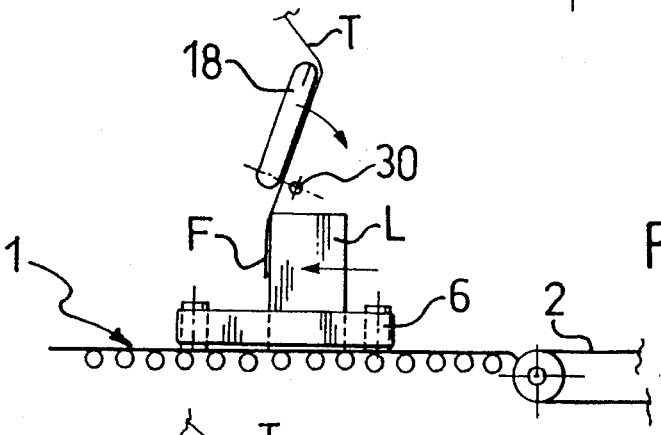

After about one half of the rotation, the pin 30 is projected. This is controlled by a position sensing means similar to that shown in FIG. 24 except that only a single sensor is required in conjunction with a single cam. The single sensor activates the projection of the pneumatic cylinder 32 associated with pin 30. The handle tape T is maintained at a distance from the topside of the load to form a loop portion M. The corresponding portion of the handle tape making up the loop portion M comprises a non-adhesive portion of the adhesive side of the handle tape T. This phase is shown in FIG. 16.

Figure 17:
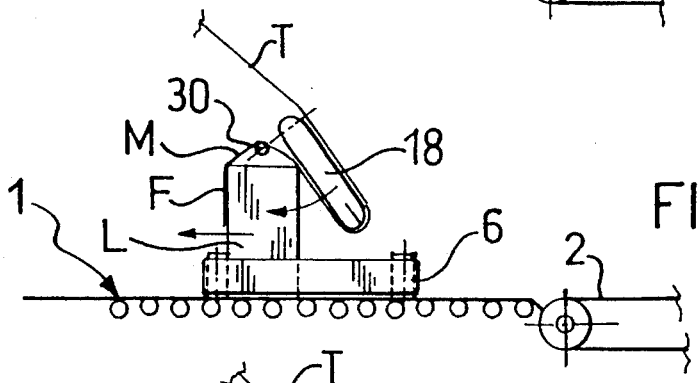

The rotational speed of the shaft 12 is set so that the arm 18 runs faster than the load L moves along the path 1. Therefor, the other side of arm 18 hits the backside of the load L. The trailing portion B of the tape T which is carried by arm 18 at this moment is also an adhesive portion. Thus, it is adhered to the load L as a result of the impact. It is to be noted that the pin 30 is retracted before impact of the arm 18 against the load L to allow free application of the tape T to the load L. Again, the retraction is controlled by the sensing means and deactivation of the pneumatic cylinder 32 associated with pin 30. This operational phase is shown in FIG. 17.

Figure 18:
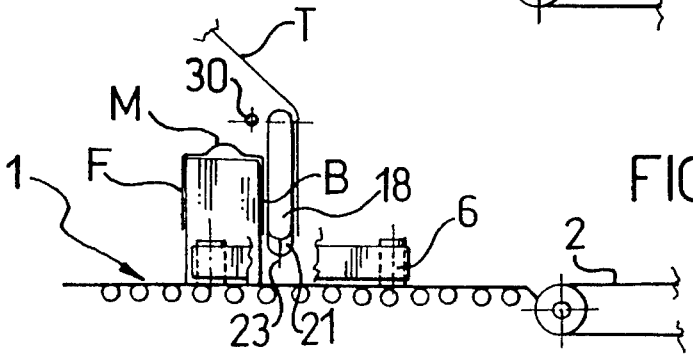

Once the arm 18 reassumes its rest position within the load path 1, the first position sensing means (not shown) reactivates the brake and deactivates the clutch 15. Thus, the arm 18 is stopped from rotation after a complete rotation of approximately 360° . This operational phase is illustrated in FIG. 18. During the latter portion of such operation, the tape T is cut as will be more fully described below.

As previously described, the cut procedure is activated by an optical sensor that senses when a full handle length has been dispensed. Moreover, a third position sensing means, such as that shown in FIG. 25 except with only one of sensors 61 and 62, readies the cutting procedure. As above, the exact instant of activation is preferably controlled by the optical sensor. The cutting operation normally occurs just after the arm 18 impacts the backside of the load L, the length of the handle H having been chosen according to the dimensions of the loads L. The cutting operation includes, as described above, an initial movement of only the blade 23 followed by the combined movement of the blade 23 and body 21 of the arm 18. The lost motion mechanism permits the initial cutting of the tape T into the individual handle H that has been applied to the load L followed by the complete adhering of the trailing edge B to the backside of the load L. At the end of this working cycle, the blade 23 and body 21 remain in their projected position, and they are ready to be hit by the next incoming load L. Again, both are retracted under control of the third position sensing means just after the next incoming load hits the arm 18.

Figure 19:
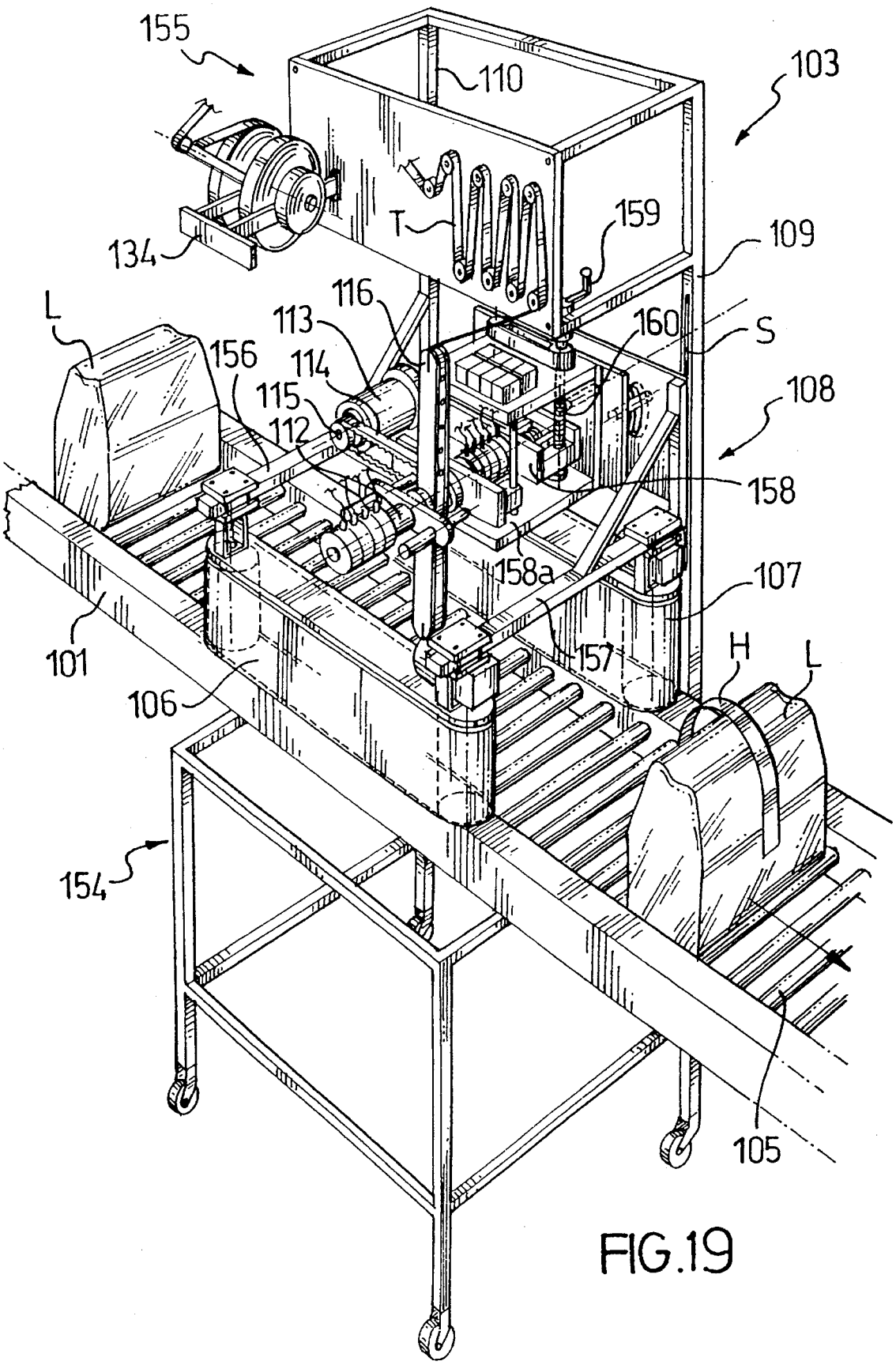
FIG. 19 is a schematic perspective view of a preferred embodiment of the apparatus according to the invention, provided as part of a load path.

Yet another embodiment of an apparatus in accordance with the present invention is illustrated in FIG. 19. The FIG. 19 embodiment functions in basically the same way as the FIG. 1 embodiment except that the supporting structure is somewhat different in order to provide a more adjustable apparatus and a means is additionally provided for manufacturing a handle tape that comprises a tape of individual handles in sequence as a part of the apparatus. The detailed description below will concentrate on those parts which are different from that of the embodiment described above.

Similar to the FIG. 1 embodiment, as shown in FIG. 19, L indicates a generic load which may be constituted by a simple box or by any number of other packages and goods. The loads L are driven along a load path 101, which comprises, for example, a number of idle rollers 105 which form a part of the load path 101. In approximately the middle portion of the load path 101 of the subject apparatus, a station 103 is provided for the application of handles H to loads L that are driven along the load path 101. The station 103 generally includes a supporting structure 154 including two uprights 109 and 110 which together support a handle tape manufacturing apparatus 155 and the applying apparatus 108 of the present invention.

As in the above embodiment, handles H are fed to the apparatus 108 in the form of a handle tape T. However, in this embodiment, the handle tape is also preferably manufactured at the station 103 by a handle tape manufacturing apparatus 155. Such an apparatus 155 is of a known type, such as for example, the apparatus described in commonly owned U.S. Pat. No. 4,906,319 which is fully incorporated herein by reference. Basically, the handle tape manufacturing apparatus 155 converts a single-sided adhesive tape to a handle tape T made up of consecutive tape handles. This is accomplished by applying discrete lengths of a second tape of strip material along spaced portions of the adhesive tape. The length of each handle and the non-adhesive portion thereof are determined according to the specifications for the specific load L. The result is that the handle tape T is supplied from the handle tape manufacturing apparatus 155 to the lever 116 for application to loads L in a manner similar to that described above.

Figure 20:
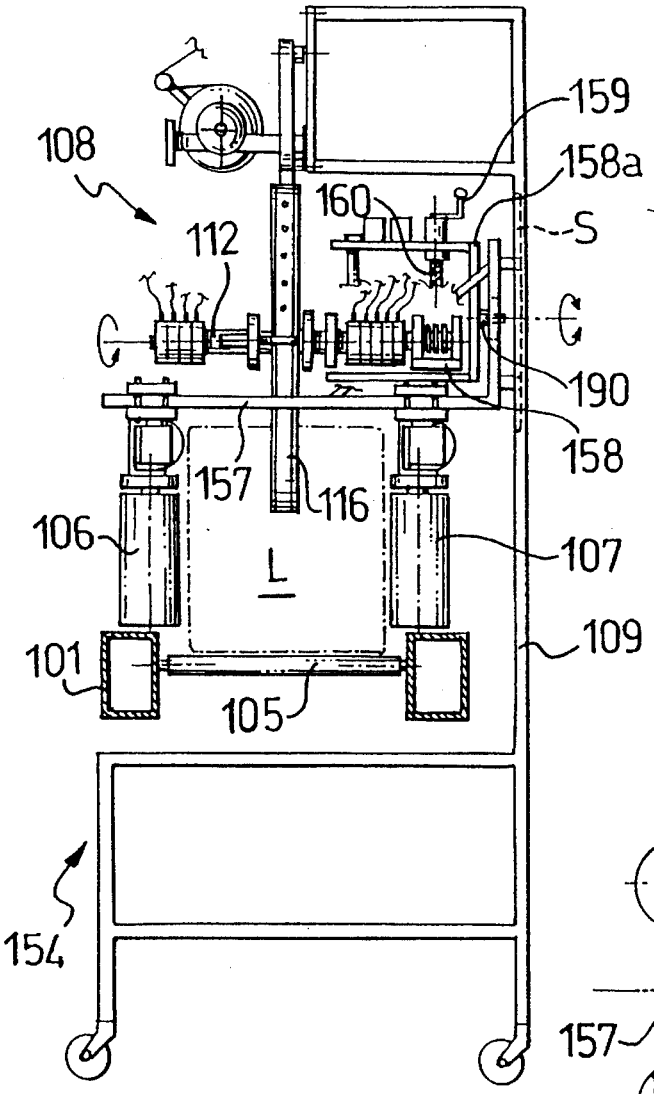
FIG. 20 is a schematic side view of the apparatus of FIG. 19.
Figure 21:
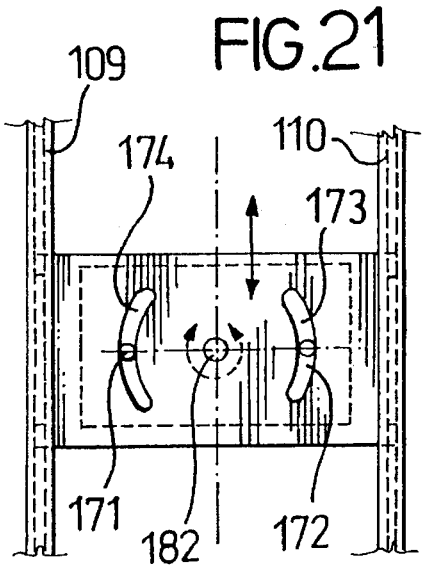
FIG. 21 is a schematic partial back view of a preferred embodiment of the apparatus of FIG. 19.
Figure 22:
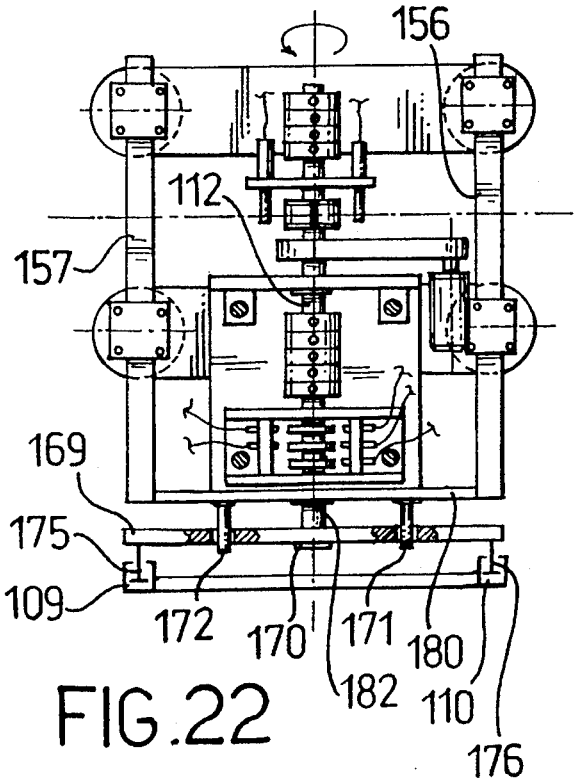
FIG. 22 is a schematic top view of a preferred embodiment of the apparatus of FIG. 19.

Referring also to FIGS. 20–22, the supporting structure of the apparatus includes uprights 109 and 110 located at the same side of the load path 101. The apparatus 108 of the present invention for applying the tape handles to loads L is adjustably mounted with respect to the two uprights 109 and 110. More specifically, a pair of L-frame members 156 and 157 are provided which include portions thereof that are slidingly engaged within slots S provided on the two uprights 109 and 110. The L-frame members 156 and 157 are conventionally movably adjustable with regard to the uprights 109 and 110 so that the substantially horizontal legs thereof can be set in a horizontal position within a predetermined range from the level of the load path L defined by idle rollers 105. A lead screw mechanism (not shown) is preferably used for providing such adjustment and positioning, which may be located within the uprights 109 and 110, or may be provided anywhere between the frame members 156 and 157 and any other non-moving portion of the supporting frame for the apparatus. The L frame members 156 and 157 are further connected with one another so that they move together as a single structure.

Powered side belts 106 and 107 are adjustably provided depending downwardly from the substantially horizontal legs of the L-frame members 156 and 157. Conventional resettable clamp mechanisms are provided to make such an adjustable connection. Thus, the powered side belts 106 and 107 can be adjusted according to the position of the load path 101 and the width of the load L which is to pass along the load path 101.

An intermediate supporting structure 158 is also provided which is connected with the L-frame members 156 and 157. The intermediate supporting structure 158 further movably supports a shaft support and bearing structure 158A which in turn supports the rotating shaft 112 over the load path 101. The support and bearing structure 158A is vertically adjustably connected to the intermediate supporting structure 158 by a lead screw arrangement 160 which can be driven by a crank 159. The lead screw 160 is fixed in axial position, so that rotation thereof reacts with a non-rotational threaded portion of the support and bearing structure 158A to thereby cause the support and beating structure 158A to move vertically along the lead screw 160. Thus, the rotating shaft 112 is vertically adjustable with regard to the L-frame members 156 and 157, which are themselves vertically adjustable with regard to the remainder of the supporting apparatus 154, as discussed above. By this, not only are the powered side belts 106 and 107 adjustable horizontally and vertically, the rotating shaft 112 is vertically adjustable with respect to the powered side belts 106 and 107.

The elements of the rotating shaft 112 are the same as that described above with regard to the FIG. 1 embodiment. Specifically, a lever 116 is provided including a pair of opposed arms to extend within the load path 101 for a particular load L. The appropriate sensors, pneumatic connections and control systems are also provided in a similar manner. Since the description and operation of these elements are exactly the same as that described above, no further explanation will be provided at this point for those features.

It is also preferable that the intermediate supporting structure 158, the support and bearing structure 158A, and the rotating shaft 112 be rotationally adjustable as a unit about an axis that extends perpendicular to the supports 109 and 110 and over the load path 101. As shown in FIG. 20, this can be accomplished by providing a pivot pin 190 extending from the vertical portion of the intermediate structure 158 that is pivotally supported by a bearing surface provided on the vertical portion of the joint structure comprising L-frame members 156 and 157. The pivot pin 190 can be conventionally secured to the bearing surface, such as by C-clips and the like. Moreover, the rotational connection may include means for locking the intermediate structure 158 relative to the L-frames 156 and 157 in multiple positions. Such locking means can comprise any of known friction lock, detent lock or the like mechanisms.

Another manner of providing such a rotational adjustment is illustrated in FIGS. 21 and 22. This manner is further advantageous in that the L-frame members 156 and 157 are not only vertically adjustable with respect to the supporting frame 154, they are also rotatable as a unit about the axis extending perpendicular to the supports 109 and 110 and extending over the load path 101. Moreover, the side belts 106 and 107 are also adjustable with the L-frame members 156 and 157. To do this, a plate 169 is operatively positioned between the uprights 109 and 110 and the L-frame members 156 and 157. The plate 169 includes elements 175 and 176 which are slidably engaged within the slots S provided on the uprights 109 and 110. It is the plate 169 which is thus vertically adjustable with regard to the uprights 109 and 110 by a conventional adjustment mechanism. The L-frame members 156 and 157 is further connected by a back plate 180 which connects between the substantially vertical portions of the L-frame members 156 and 157.

Between the backing plate 180 and the plate 169, a pivot pin 182 and bearing structure 170 are provided so that the backing plate 180, and thus the L-frame members 156 and 157, are pivotal about the plate 169. Guide pins 171 and 172 are also provided extending from the backing plate 180 to engage within slots 173 and 174 of the plate 169. The slots 173 and 174 define the pivotal limits of the L-frame members 156 and 157 about the pivot pin 182. The backing plate 180 and the plate 169 can be conventionally locked in pivotal positions with respect to one another by any conventional locking means that may be provided integral with the pivot pin 182 or on either or both of the pins 171 and 172. This arrangement allows the apparatus 108 of the present invention to be inclined to follow a load path 101 that is not parallel to the floor on which the apparatus is located.

Figure 23:
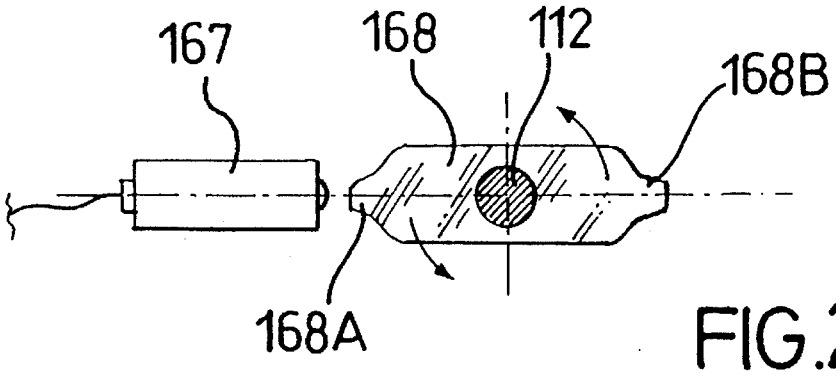
FIG. 23 is an enlarged view of the position sensing means for controlling the brake-clutch.

Again, the rotating shaft 112 and its drive motor 113, a belt 114, and a brake-clutch 115, as described above are all supported from the support and bearing assembly 158A so as to be movable together with one another. Moreover, the sensor mechanisms such as shown in FIGS. 23–25 are also provided on the rotating shaft 112.

With regard to the sensor controlling the cylinders 132 for the pins 130 and 131, a similar sensor as that shown in FIG. 24 and described above is utilized. With regard to the sensor for controlling the cylinders within the lever 116 for cutting and extending the bodies thereof, a similar sensor as that illustrated in FIG. 25 and described above is also utilized. However, for controlling the brake-clutch mechanism 115, it is contemplated to use a sensing mechanism such as that illustrated in FIG. 23 for controlling the activation and reactivation of the clutch 115 and the braking thereof.

Specifically, the cam 168 includes two lobes 168A and 168B which are sensed by a single inductive sensor 167. This sensing means is a substitute for the sensor 33 described above which triggers the clutch on and off for moving the lever 16 through a rotation of approximately 180°. In this case, both of the lobes 168A and 168B when sensed by the inductive sensor 167 deactivate the clutch of the mechanism 115 and activate the braking of shaft 112. When a load L hits the lever 116, the one of the lobes 168A and 168B which is directly in front of the inductive sensor 167 is rotated past the sensor 167 and the clutch of the mechanism 115 is activated and the shaft 112 is rotated by the motor 113. Such rotation continues for approximately 180° (or 360° for the one arm version) until the next of the lobes 168A or 168B moves to a position directly in front of the inductive sensor 167.

It is understood that many other variations and embodiments for the present invention are possible which are within the scope of the present invention. Any of the adjustable mechanisms of the subject apparatus could be power driven or manually driven. Moreover, many other types of sensor mechanisms can be utilized for triggering and controlling the operation described above.

I claim:

1. Apparatus for applying adhesive handles comprising a leading portion and a trailing portion to loads driven along a path, said apparatus comprising:

a lever having at least one arm in a position across the path;

holding means provided on said lever for carrying a handle tape laying on said arm of said lever with its non-adhesive side against said arm and its adhesive side exposed, wherein said lever is capable of adhering the leading portion of the handle to a first surface of a load when a load driven on the path contacts said arm across the path;

lever driving means for rotating said lever, wherein said lever is thereby capable of contacting a second surface of the load so as to adhere the trailing portion of the handle to the second surface of the load, said lever driving means being activated in response to a load driven across the path contacting said arm of said lever across the path; and cutting means provided on said lever to cut a handle from the handle tape.

2. Apparatus according to claim 1, wherein said lever has one arm in a position across the path, said arm includes first and second holding portions of said holding means on opposed sides of said arm and said lever driving means rotates said lever by about 360° in response to a load driven on the path contacting said first holding portion on said arm of the lever across the path.

3. Apparatus according to claim 1, wherein said lever has two opposing areas, either of said areas being in turn in a position across the path, one of said anus including said first holding portion and the other of said arms including the second holding portion, and said lever driving means rotates said lever by about 180° in response to a load driven on the path contacting said first holding portion on said arm of said lever across the path.

4. Apparatus according to claim 1, wherein the lever is a bar having two opposite smooth sliding faces for the handle tape, linked therebetween by two rounded ends of the bar.

5. Apparatus according to claim 4, wherein the rounded ends of the lever are formed on bodies movable relative to said lever between a rest position in which they allow easy sliding of the handle tape and a lap position in which they cooperate to improve sticking of the handle cut from the handle tape to the back side of the load.

6. Apparatus according to claim 1, wherein the holding means comprise holes formed on the sliding faces of the lever and permanently connected with a vacuum source.

7. Apparatus according to claim 1, wherein the cutting means cut a handle once it has been stuck to the load.

8. Apparatus according to claim 1, wherein the cutting means comprise a blade for each arm, transversely provided at the extreme position of the rounded ends of the lever, each blade being driven relative to the lever by own pneumatic means between a rest position in which it does not project from the rounded end of the lever and a cut position in which it projects from the rounded end.

9. Apparatus according to claim 8, wherein the pneumatic means of the blades operate also the rounded ends of the lever by a lost motion arrangement, which first pushes the blade out from the rounded end and then pushes forward the body of the rounded end itself.

10. Apparatus according to claim 8, wherein the pneumatic means comprise a pneumatic cylinder connected to a sliding hammer head, which is solid to the blade and engaged in a respective seat in the body of the rounded end, the hammer head having a stroke within the seat, correspondent with the projection of the blade from the rounded end, the stroke of the pneumatic cylinder being greater than the stroke of the hammer head within the seat by a value corresponding to the value of the projection of the body of the rounded end from the lever.

11. Apparatus according to claim 8, wherein the pneumatic means of the blades are activated by the combined action of a position sensor which senses which arm has to be activated and an optical sensor which is oriented toward the fed handle tape and senses when a complete handle has been fed.

12. Apparatus according to claim 2, comprising a loop forming arrangement, including a retractable pin mounted on the lever in a position laterally projecting from the middle of the lever, said pin being driven by a pneumatic mean between a retracted position and a projection position.

13. Apparatus according to claim 3, comprising a loop forming arrangement, including two retractable pins mounted on the lever in respective positions laterally projecting from the middle of the lever, each pin being driven by own pneumatic means between a retracted position and a projecting position.

14. Apparatus according to claim 1, wherein the lever driving means comprise an electric motor and an electric brake-clutch, activated by a position sensing mean which detects when the lever is moved by the impact of the load.

15. Apparatus according to claim 1, wherein said apparatus is slidingly engaged with two uprights, to modify the height of the apparatus relative to the load path.

16. Apparatus according to claim 1, wherein the lever is keyed on a rotating shaft, said rotating shaft being borne by a supporting structure provided with an endless screw arrangement to modify the height of the rotating shaft relative to the path.

17. Apparatus according to claim 1, wherein said apparatus comprises two powered side belts slidingly engaged with two projecting beams, to modify the width of the space between said powered side belts.

18. Apparatus according to claim 1, wherein said apparatus is in a rotatable connection with a supporting plate slidingly engaged with two uprights.

19. Apparatus according to claim 1, wherein said lever is capable of adhering the leading portion of the handle and the trailing portion of the handle to generally opposing first and second surfaces of the load, respectively.

20. Apparatus according to claim 19, wherein said lever is capable of adhering the leading portion and the trailing portion of the handle to the first and second surfaces of the load which are separated by a third surface.

21. Apparatus for applying adhesive handles comprising a leading portion and a trailing portion to loads driven along a path, said apparatus comprising:

a lever having at least one arm in a position across the path;

holding means provided on said lever for carrying a handle tape laying on said arm of said lever with its non-adhesive side against said arm and its adhesive side exposed such that the lever is capable of adhering the leading portion of the handle to a first surface of a load when the first surface of the load driven on the path contacts said arm of said lever;

lever driving means for rotating said lever such that said lever is capable of contacting a second surface of the load generally opposed to the first surface so as to adhere the trailing portion of the handle to the second surface of the load in response to the first surface of the load contacting said arm of said lever across the path; and cutting means provided on said lever to cut a handle from the handle tape.

22. Apparatus for applying adhesive handles comprising a leading portion and a trailing portion to loads driven along a path, said apparatus comprising:

a lever having at least one arm in a position across the path;

holding means provided on said lever for canning a handle tape laying on said arm of said lever with its non-adhesive side against said arm and its adhesive side exposed such that the lever is capable of adhering the leading portion of the handle to a first surface of a load when the first surface of the load driven on the path contacts said arm of said lever;

lever driving means for rotating said lever such that said lever is capable of contacting a second surface of the load so as to adhere the trailing portion of the handle to the second surface of the load;

sensing means for sensing when said arm of said lever across the path is displaced in response to being contacted by the load and for activating said lever drive means in response to displacement of said arm; and cutting means provided on said lever to cut a handle from the handle tape.

23. Apparatus for applying adhesive handles comprising a leading portion and a trailing portion to loads driven along a path, said apparatus comprising:

a lever having at least one arm in a position across the path;

holding means provided on said lever for canning a handle tape laying on said arm of said lever with its non-adhesive side against said arm and its adhesive side exposed such that the lever is capable of adhering the leading portion of the handle to a first surface of a load when the first surface of the load driven on the path contacts said arm of said lever;

lever driving means for rotating said lever more than 90° such that said lever is capable of contacting a second surface of the load so as to adhere the trailing portion of the handle to the second surface of the load in response to the first surface of the load contacting said arm of said lever across the path; and cutting means provided on said lever to cut a handle from the handle tape.

* * * * *

UNITED STATES PATENT AND TRADEMARK OFFICE

CERTIFICATE OF CORRECTION

PATENT NO.: 5,458,726

DATED: October 17, 1995

INVENTOR(S): Roberto Castoldi

It is certified that error appears in the above-identified patent and that said Letters Patent is hereby corrected as shown below:

Column 5, line 63, "beating" should be --bearing--.

Column 7, line 43, "lately" should be --largely--.

Column 9, line 31, delete the comma after "are".

Column 12, line 23, "earn" should be --cam--.

Column 18, line 38, "reactivation" should be --deactivation--.

Claim 3, column 19, line 26, "two opposing areas, either of said areas being" should be --two opposing arms, either of said arms being--.

Claim 3, column 19, line 27, "anus" should be --arms--.

Claim 22, column 21, line 5, "canning" should be --carrying--.

Claim 23, column 22, line 5, "canning" should be --carrying--.

Signed and Sealed this

Thirtieth Day of July, 1996

*Attest:*

*Attesting Officer*

Bruce Lehman

BRUCE LEHMAN

*Commissioner of Patents and Trademarks*